US005731282A

United States Patent [19]

Duquesne

[11] Patent Number: 5,731,282

[45] Date of Patent: Mar. 24, 1998

[54] CLEANING/DISINFECTING CONCENTRATE AND METHODS

[75] Inventor: Jean-Pierre Duquesne, 1, rue de Cahaignes. "le Claireau" , 27290 Montfort /Risle, France

[73] Assignee: Jean-Pierre Duquesne, Montfort-sur-Risle, France

[21] Appl. No.: 565,030

[22] Filed: Nov. 30, 1995

[51] Int. Cl.[6] ..... C11D 1/72; C11D 1/835; C11D 3/50

[52] U.S. Cl. ..... 510/423; 510/403; 510/421; 510/433; 512/2; 512/3

[58] Field of Search ..... 252/547, 174.11, 252/174.21; 512/2, 3; 510/403, 421, 423, 433

[56] References Cited

U.S. PATENT DOCUMENTS

| | | | |
|---|---|---|---|
| 2,875,131 | 2/1959 | Carpenter et al. | 167/94 |
| 2,889,254 | 6/1959 | Fiore et al. | 167/94 |
| 2,918,412 | 12/1959 | Wood | 167/94 |
| 3,733,277 | 5/1973 | Wooden et al. | 252/106 |
| 3,790,484 | 2/1974 | Blair | 252/89 |
| 4,145,184 | 3/1979 | Brain et al. | 8/137 |
| 4,209,417 | 6/1980 | Whyte | 252/174.11 |
| 4,371,461 | 2/1983 | Jones et al. | 252/547 |
| 4,394,127 | 7/1983 | Melville | 8/137 |
| 4,536,315 | 8/1985 | Ramachandran et al. | 252/174.11 |
| 4,787,984 | 11/1988 | Hutchings et al. | 210/698 |
| 4,787,998 | 11/1988 | Rennie et al. | 252/174.11 |
| 4,863,629 | 9/1989 | Osberghaus et al. | 252/162 |
| 4,973,422 | 11/1990 | Schmidt | 252/174.11 |
| 5,075,025 | 12/1991 | Wainberg et al. | 252/95 |
| 5,143,900 | 9/1992 | Steltenkamp et al. | 512/26 |
| 5,288,423 | 2/1994 | Behan et al. | 252/174.11 |
| 5,336,665 | 8/1994 | Garner-Gray et al. | 512/4 |

FOREIGN PATENT DOCUMENTS 0 404 470 12/1990 European Pat. Off. .

*Primary Examiner*—Paul Lieberman
*Assistant Examiner*—Gregory R. Delcotto
*Attorney, Agent, or Firm*—Sterne, Kessler, Goldstein & Fox P.L.L.C.

[57] ABSTRACT

A cleaning/disinfecting concentrate is provided that includes a concentrate having, in admixture, 30–70% by volume of a detergent; 10–40% by volume of a non-emulsified fragrance; and 5–20% by volume of a preservative/disinfectant, wherein the ratio of detergent/surfactant to perfume/disinfectant is 0.75–5.0 by volume, as well as methods of making and using thereof.

18 Claims, 21 Drawing Sheets

2/21

CLEANING/DISINFECTING CONCENTRATE AND METHODS

BACKGROUND OF THE INVENTION

1. Field of the Invention

The present invention, in the field of cleaning and disinfectant compositions and methods, relates to a cleaning/disinfectant concentrate, and methods for making and using thereof.

2. Related Art

Cleaning/disinfectant concentrates, detergents and soaps that contain ≦1% perfume/fragrance are well known in the art. They are formulated and used for commercial or domestic cleaning and/or disinfecting of hard surfaces, e.g., floors, walls, baths, lavatories, tiles, kitchens, etc. However, the fragrance thus provided in the concentrate often lasts only a relatively short time, as the perfume evaporates quickly and is then no longer noticeable.

Moreover, often the cleaning/disinfecting composition has only a short residence time on the surface to be cleaned, thus leaving relatively little time for the perfume to evaporate and impart a pleasant fragrance to the cleaned or disinfected surface and its surroundings. If the cleaning/disinfectant operation is followed by a rinsing step, this usually causes a further reduction of the residence time of the perfume present on the surface of the substrate.

It is known that chlorine-containing liquid disinfectants (e.g., sodium hypochlorite) are useful in destroying pathogens. However, these disinfectants suffer from the problem that the chlorine odor is unpleasant, discouraging its use. In addition, a chlorine-containing disinfectants tend to have a short shelf life, due to the relative instability of aqueous hypochlorite. Accordingly, there is a need to provide disinfectant concentrates having effective pathogenic activity, while also having a pleasant and long-lasting odor which encourages their use.

Accordingly, there is a need to provide cleaning/disinfectant concentrates providing a prolonged, pleasant odor and enhanced sense of cleanliness, when used for commercial or domestic cleaning or disinfecting.

SUMMARY OF THE INVENTION

The present invention is provided to overcome one or more deficiencies of the related background art.

The present invention provides a cleaning/disinfecting concentrate having unexpected properties, such as a prolonged pleasant odor from surfaces on which it is used in diluted or undiluted form, as well as having a stable shelf life even though a high concentration of perfume/fragrance is used, in non-emulsified form. The use of a concentrate, or dilution thereof, of the present invention is now discovered to provide a prolonged sense of cleanliness.

The present invention generally provides a cleaning/disinfecting concentrate comprising 10–40% of a non-emulsified perfume/fragrance; 30–70% of a non-ionic detergent/surfactant; and 5–20% of a preservative/disinfectant. The ratio of detergent/surfactant to perfume/fragrance is 0.75–5.0 by weight percent (wgt. %) or volume (vol.).

The present invention is discovered to provide unexpected cleaning, disinfecting and pleasant odor properties, by the use of a very high percentage of a non-emulsified fragrance/perfume, in the range of 10–40%. The unexpected properties are also provided by the combination of at least one of the above percentages of non-ionic detergent/surfactant, preservative/disinfectant or ratios thereof.

A cleaning/disinfecting concentrate of the present invention can be made, in one aspect, by a method comprising the steps of providing the detergent/surfactant in liquid form; mixing in the preservative/surfactant and perfume/fragrance; and letting the mixture stand for a period of time until the mixture, suspension or solution is substantially homogenous.

A cleaning/disinfecting concentrate can be used for any cleaning or disinfecting of hard surfaces, in diluted or undiluted form, with a diluted form preferred. The dilution is preferably effected with an aqueous solvent, such as water.

Other objects, features and advantages of the present invention will become apparent to those skilled in the art from the following detailed description and representative examples. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

Figure 1:
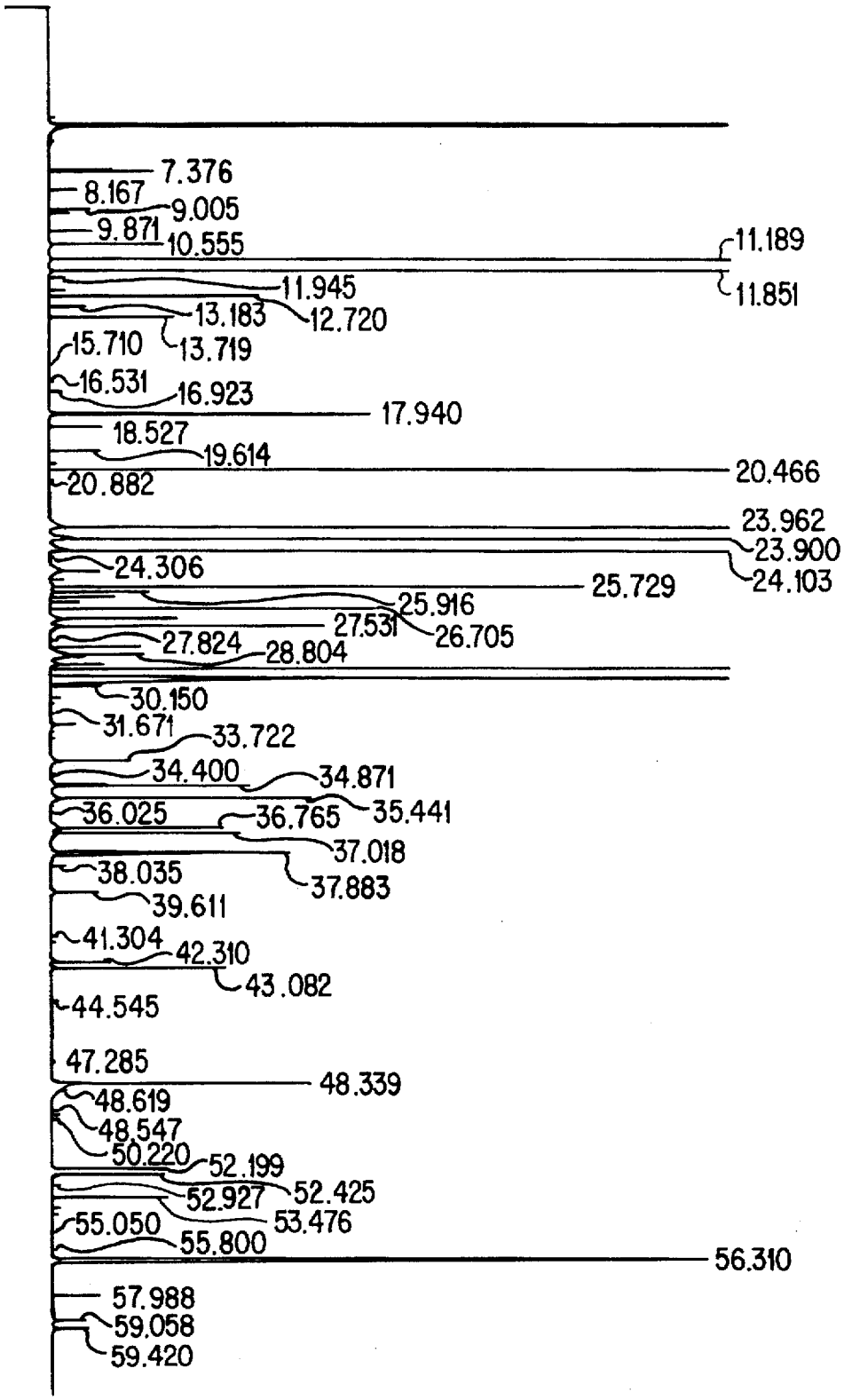
FIG. 1 is a gas-liquid chromatography (GLC) profile for the fragrance Lavende PC 23696.

The present invention provides cleaning/disinfecting concentrates and methods of making and using thereof. These concentrates were developed based on the discovery of using a very high percentage (e.g., 10–40%) of a non-emulsified flagrance or perfume, in admixture, suspension or solution with at least the additional components of a suitable non-ionic detergent/surfactant and a preservative/disinfectant. This composition unexpectedly provides a cleaning/disinfecting concentrate with unexpectedly enhanced cleaning/disinfecting properties, when used in diluted or undiluted form. These unexpected properties include prolonged, pleasant odor which is found by users to provide a prolonged sense of cleanliness. The high percentage perfume in the concentrate is also unexpectedly stable upon storage, in diluted or non-diluted form.

Cleaning/Disinfecting Concentrates

The cleaning/disinfecting concentrates as described herein generally comprise products used for commercial or domestic cleaning/disinfecting purposes, but can also be used for other purposes, such as general purpose cleaning, deodorizing or disinfecting.

The concentrates of the present invention are characterized by generally possessing a relatively high level of detergent/surfactant, i.e., generally between 30 and 70%, typically between 45 and 65% by weight or volume, which detergent/surfactant may be non-ionic, anionic, cationic, amphoteric or mixtures thereof, with nonionic and anionic preferred. Furthermore, concentrates according to the invention generally comprise 10–40% of perfume/fragrance; 5–20% preservative/disinfectant, 0–55% by weight of an aqueous solvent, and 0–55% of optional adjuncts, as described herein and/or as known in the related arts. The total of these ingredients in a cleaning/disinfecting concentrate is hereinafter referred to as a "cleaning/disinfecting concentrate" according to the present invention.

The exact composition of the cleaning/disinfecting concentrate of the present invention depends on the type of product and its intended use, as determined by one of ordinary skill in the art, based on the teaching and guidance presented herein.

A cleaning/disinfecting composition of the present invention is generally applied by first diluting with water or other aqueous solvent, preferably in a volume ratio of from about 1:10,000 to 1:0, and more preferably a ratio from about 1:1500 to 1:4 (cleaning/disinfecting composition:water or aqueous solvent). The surfaces to be treated are then wiped with the dilute solution thus prepared, for example, using a spray, a sponge or a cloth. In general, the cleaning/disinfecting concentrate can be used in less diluted form on heavily soiled or stained surfaces. The surface, after such cleaning/disinfecting with low dilutions, can optionally be further cleaned/dinsinfeced using a higher dilution of the cleaning/disinfecting solution, and/or rinsed with water. It is preferred that the cleaned surface not be rinsed with water, in order to enhance the prolonged fragrance and sense of cleanliness.

For use as a cleaning solution, the relative amount of preservative/disinfectant is preferably from about 5–15%, and more preferably from about 5% to 10%. The cleaning/disinfecting concentrate is preferably diluted as about 0.1–50 grams of concentrate per liter (g/l) of water for use as a cleaning/disinfecting solution such as about 0.1–40, 1–30, 2–20, 2–10 g/l. Alternatively, the cleaning/disinfecting concentrate can be diluted to about an 8–15% solution (preferably 10–14%, e.g., 12%) which is then optionally further diluted to about 0.5–100 ml/l concentrate/water for cleaning/disinfecting purposes, such as about 0.5–50, 1–40, 3–20, 6–10 or 10–40 ml/l.

For use as a disinfecting solution, the relative amount of disinfectant is increased, preferably from about 10% to 20%, and more preferably from about 15% to 20% or about 12–15%. The concentrate is then diluted for use using 1–100 g/l concentrate/water, such as about 1–30, 2–40, 5–50, 10–60 or 20–80 g/l. Alternatively, the concentrate is first diluted to about 8–15% (preferably 10–13%) solution, which is then added to water as about 1–100 ml/l, such as about 1–50, 2–40, 3–30, 6–10 or 10–40 ml/l. Preferably, the concentrate is used as about 50 mls per 8 liters. A cleaning/disinfecting concentrate according to the present invention can be in the form of a liquid, a highly viscous liquid or a gel.

See, e.g., Lange, ed., *Handbook for Detergent Formulators,* Hanser-Gardner Publishers, Cincinnati, Ohio (1994); Sittig, *Detergent Manufacture Including Zeolite Builders and Other New Materials,* Noyes Publications, Park Ridge, N.J. (1979); *Chemicals for the Detergent Industry,* Business Communications, Inc., Norwalk, Conn. (1987); Cutler et al., *Detergency: Theory and Technology,* Dekker, N.Y. (1987); Allured, ed., *McCutcheon's Functional Materials:* International & North American Edition, MC Publishing Co., New Jersey (1995); Longman, *The Analysis of Detergents and Detergent Products,* Books on Demand, Ann Arbor, Mich. (1989), which references are entirely incorporated herein by reference with regard to their teaching of formulation and components which can be used for making and using a cleaning/disinfecting concentrate of the present invention.

Perfumes/Fragrances

As used herein the term "perfume" or "fragrance" denotes one or a mixture of natural or synthetic non-emulsified perfume or fragrance components, optionally mixed with a suitable solvent, diluent or carrier, which is used in a cleaning/disinfecting concentrate of the present invention and/or in use and/or to the surface that the diluted or undiluted concentrate is used on. The fragrance/perfume composition used in the present invention can be in any form that provides a suitable and homogeneous mixture, solution or suspension with the other components of a cleaning/disinfecting concentrate of the present invention.

Suitable characteristics of such perfumes/fragrances can include at least one of the following, in any combination: (1) liquid or semi-liquid after mixing with the other components; (2) pleasant and/or clean odor when mixed with other components, e.g., one or more of lavender, violet, rose, jasmin, pine, woody, floral, fruity, lemon, lime, apple, peach, raspberry, strawberry, banana, plum, apricot, vanilla, pear, eucalyptus, aromatic, aldehydic, tutti frutti, oriental, sweet, amber, Paola, Muguet, citronella, and the like; (3) specific gravity (20/20) in the range of 0.600–1.300, preferably 0.800–1.100, each preferably varying 0.001–0.05, more preferably 0.008–0.020; (4) refractive index (20° C.) of 1.300–1.800, preferably 1.400–1.600, each preferably varying 0.001–0.05, more preferably 0.008–0.020; (5) saponification value of 5–300, preferably 10–250; and (6) having a flash point of 20–200 Pensky-Martens Closed Cup (P.M.C.C.) and 10–100 Tag-Closed Cup (T.C.C.).

Perfume/fragrance components and mixtures thereof that can be used for the preparation of such perfumes/fragrances can be one or more selected from the group consisting of:

natural products, such as essential oils, absolutes, resinoids, resins, concretes, etc.; and/or synthetic perfume components, such as hydrocarbons, alcohols, aldehydes, ketones, ethers, acids, esters, acetals, ketals, nitriles, etc., including saturated and unsaturated compounds and aliphatic, carbocyclic and heterocyclic compounds.

Examples of such perfume/fragrance components can be at least one selected from the group consisting of: geraniol, geranyl acetate, linalol, linalyl acetate, tetrahydrolinalool, citronellol, citronellyl acetate, dihydromyrcenol, dihydromyrcenyl acetate, nopol acetate, 2-phenylethanol, 2-phenylethyl acetate, benzyl alcohol, benzyl acetate, benzyl salicylate, benzyl benzoate, styrallyl acetate, amyl salicylate, dimethylbenzylcarbinol, trichloromethylphenycarbinyl acetate, p-term-butylcyclohexyl acetate, isonomyl acetate, vetiveryl acetate, vetiverol, alpha-n-amylcinammic aldehyde, aphaohexylcinammic aldehyde, 2-methyl-3-(p-term-butyl phenyl)propanal, 2-methyl-3-(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3-cyclohexenecarbaldehyde, 4-acetoxy-3-pentyltetrahydropyran, methyl dihydrojasmonate, 2-n-heptylcyclopentanone, 3-methyl-2-pentylcyclopentanone, n-decanal, n-dodecanal, 9-decenol-1, phenoxyethyl isobutyrate, phenylacetaldehyde dimethyl acetal, phenylacetaldehyde diethyl acetal, geranonitrile, citronellonitrile, cedryl acetate, 3-isocamphylcyclohexanol, cedryl methyl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musk fragrances, tetralin musk fragrances, isochroman musk fragrances, macrocyclic ketones, macrolactone musk fragrances, ethylene brassylate, aromatic nitromusk fragrances.

Preferred perfumes/fragrances include at least one selected from the group consisting of LAVENDER PC 23696, CITRUS PC 23969, MIMOSA PC 24309, ZESTY PC 24219, VIOLETTE PC 27410, SPITZ PC 24736, POMME I PC 25003, CHYPRE PC 24447, GUM II PC 27038, ZESTE PC 24449, ARDANTE PC 24448, VANILLAROME PC 24217, PAOLA PC 24310, EUCALYPTUS PC 24583, NECTAR PE 24180, MUGUET PC 24311, GUM I PC 24446, GRANY PC 24453, CITRONELLE PC 24584, JASMIN PC 25512, CITRONADE PC 27039 (each available from Kao Corporation, Barcelona, Spain). Similar perfumes can also be preferably used. The specific characteristics and gas-liquid chromatography data on each of these fragrances is presented in Example 1.

Suitable solvents, diluents or carriers for perfumes as mentioned above are aqueous or alcohol based, e.g., ethanol, isopropanol, diethylene glycol monethyl ether, dipropylene glycol, diethyl phthalate, triethyl titrate, and the like, as known in the art.

The perfume/fragrance component of the present invention is present in concentrates of the invention in a quantity of from about 10–40% by weight or volume, or any range or value therein, preferably in a quantity from about 20–35% by weight or volume, and more preferably in a quantity of from about 25–35% by weight or volume. A preferred quantity is about 30% by weight or volume.

See, e.g., Lange, supra, Sittig, supra; *Chemicals for the Detergent Industry,* supra; Cutler, supra, Ramsbotham, *Tenside Detergents* 23: 325–332 (1986); Morris, *J. Am. Oil Chemist's Soc.* 55: 41–43 (1978); Allured, supra, which references are entirely incorporated herein by reference with regard to their teaching of perfumes and/or fragrances.

Detergents/Surfactants

Detergents/surfactants suitable for use in a cleaning/disinfecting concentrate of the present invention are detergents or surfactants of the nonionic, anionic, amphoteric or zwitterionic type. U.S. Pat. No. 3,664,961, disclosing such detergent/surfactants, is entirely incorporated herein by reference. The detergent/surfactant component is present in concentrates of the invention in a quantity of from about 30–70% by weight or volume, or any range or value therein, preferably in a quantity from about 40–65% by weight or volume, and more preferably in a quantity of from about 50–65% by weight or volume. A preferred quantity is about 60%.

Non-limiting examples of anionic detergents that can be used in a cleaning/disinfectant concentrate of the present invention include alkanesulfonates containing 12–20 carbon atoms in the alkyl group, monoalkyl sulfates containing 12–14 carbon atoms in the alkyl group, and alkyl ether sulfates containing 12–18 carbon atoms in the alkyl group and from 2–6 etheylene oxide (EO) units in the ether portion. Examples of such detergents/surfactants are sodium laurel ether sulfates, sodium coconut alkyl sulfate and sodium sec.-alkanesulfonate containing 14–16 carbon atoms. When anionic detergents/surfactants are used in a cleaning/disinfecting concentrate of the invention, it is preferred that preservatives/disinfectants other than cationic (e.g., quaternary ammonium halides) be used, when such combinations do not provide a homogeneous concentrate according to the present invention. For example, when a quaternary ammonium chloride is used as a preservative/disinfectant, an ionic detergent/surfactant is preferably used.

Nonionic detergents/surfactants that can be used in a concentrate of the present invention, as non-limiting examples, include primarily ethoxylated long-chain alcohols containing from 12 to 18 carbon atoms in the alkyl group and from 5 to 15 ethylene oxide traits (EO), ethoxylated alkylphenols containing from 8 to 10 carbon atoms in the alkyl group and from 8 to 14 ethylene oxide units, ethoxylated fatty acid amides containing from 12 to 18 carbon atoms in the fatty acid part and from 2 to 8 ethylene oxide units, and long-chain amine oxides containing from 14 to 20 carbon atoms. Preferred examples of such detergents/surfactants include nonylphenol ethoxylate, nonylphenol ethylene oxide condensate, nonylphenol polyethylene glycol ether, and nonylphenol containing 10 ethylene oxide units.

The adducts of ethylene oxide and fatty alcohols, alkylphenols, and fatty acid amides have proven to be particularly suitable nonionic detergents for use herein, such as nonylphenoxy (polyethyleneoxy)ethanol, (e.g., IGEPAL NP 12 (Rhône-Poulenc, Paris, France), nonylphenol ethyloxylate, ethylene oxide-nonylphenol concentrate or polymer, ethoxylated nonylphenol, mono(nonylphenyl) polyethylene glycol, nonylphenol polyethylene oxide, nonylphenol polyethylene glycol ether, nonyl phenoxypoly (ethyleneoxy)ethanol, nonylphenoxypoly(oxyethylene) ethanol, and/or nonylphenyl polyethylene glycol ether.

See, e.g., Myers, *Surfactant Science and Technology,* VCH Publishers, Inc., New York (1992); Cutler, supra; Rosen, *Surfactants and Interfacial Phenomena,* Wiley, N.Y. (1984); Schick et al. *Surfactant Science Series,* Vols. 1–22, Dekker, N.Y. (1961–1987); Tadros, *Surfactants,* Academic Press, London (1984); Ramsbotham, supra; Morris, supra; U.S. Pat. Nos. 3,664,961 and 4,863,629, Lange, supra; Sittig, supra; *Chemicals for the Detergent Industry,* supra, Longman, supra; Allured, supra, which references are entirely incorporated herein by reference with regard to their teaching of detergents and/or surfactants.

Preservatives/Disinfectants

Preservatives/disinfectants suitable for use in a cleaning/disinfecting concentrate of the present invention are those that form homogeneous mixtures with detergents or surfactants of the nonionic or anionic type. The preservative/disinfectant component is present in concentrates of the invention in a quantity of from about 5–20% by weight or volume, or any range or value therein, preferably in a quantity of about 5–15% by weight or volume as a preservative and of about 10–20% by weight or volume as a disinfectant. A preferred quantity for cleaning is 10%.

The preservative/disinfectant can be provided as at least one water soluble or suspendable preservative or disinfectant, that provides bacteriocidal and/or fungicidal activity. The preservative/disinfectant preferably has chemical properties that allow it to mix homogeneously with the other components of the cleaning/disinfecting concentrate, such as with the non-ionic or anionic detergent/surfactant and perfume/fragrance.

As a non-limiting example, the preservative/disinfectant can be cationic, such as a quaternary ammonium halide. Such quaternary ammonium chlorides are preferably a benzyl alkyl chloride. Examples of such preservatives/disinfectants include dialkylbenzyl dimethyl ammonium chloride and benzylcoco alkyldimethyl chloride. The dialkylbenzyl dimethyl chloride is preferably RHODAQUAT RP (Rhône-Poulenc, Paris, France). When a quaternary ammonium halide is used, it is preferably used with a non-ionic detergent.

See, e.g., Lange, supra; Sittig, supra; *Chemicals for the Detergent Industry,* supra; Cutler supra; Longman, supra; Allured, supra, which references are entirely incorporated herein by reference with regard to their teaching of preservatives or disinfectants.

Adjuncts

In addition to the components described above, hydrophilic adjuncts may also be present in the cleaning/disinfecting concentrate at a level of 0–55% by weight of the aqueous phase according to the nature of the detergent product to which the perfume/fragrance is to be added. Examples of such materials are builders (e.g., tetrapotassium pyrophosphate) abrasives, colors, dyes, corrosion inhibitors, enzymes, alkalinity boosters, sudsing modifiers, florescent whitening agents, antiredisposition agents, softeners, antistats, bleaches, optical brighteners, thickeners, emollients, conditioners, water-soluble polymers, water-dispersible polymers, clarifiers, pearlescent agents, salts, structurants, stabilizers and/or organic solvents.

See, e.g., Allured, supra; Rosen, supra; Schick supra; Tadros, supra, Lange, supra; Sittig, supra; *Chemicals for the Detergent Industry,* supra, Cutler supra, Longman, supra; which references are entirely incorporated herein by reference with regard to their teaching of adjuncts.

Methods of Making

The concentrate can be made by using the steps of:

(a) providing the detergent/surfactant (to provide about 30–70% by volume of total mixture) in liquefied or dissolvable form;

(b) mixing in the preservative/disinfectant (to provide about 5–20% by volume of total mixture);

(c) adding the perfume/fragrance as about 10–40% by volume of the total mixture; and (d) letting the mixture stand until the mixture/suspension/solution is substantially homogeneous.

The concentrate can then be further formulated in liquid or semi-liquid form, based on the percentage and type of components, according to known method steps. Gel capsules or granules can also be formulated as an alternative to providing the concentrate in liquid form. The concentrate can be packaged in any suitable form, such as plastic, glass or biodegradable containers, and stored for several weeks to years before use.

See, e.g., Lange, supra; Sittig, supra; *Chemicals for the Detergent Industry,* supra, Cutler supra, Longman, supra, which references are entirely incorporated herein by reference with regard to their teaching of known method steps and components which can be used for making a cleaning/disinfecting concentrate of the present invention.

Methods of Using

For use as a cleaning/disinfectant composition, the concentrate can be diluted with water or other suitable aqueous solvent, such as an alcohol, a glycol, an aqueous emulsion or other solvent which provides a stable mixture of the components of the cleaning/disinfecting concentrate. The cleaning concentrate can also be stored as a dilution of 1–50% by volume, with 12–25% preferred. The containers can be of any desired volume, e.g., 1, 2, 3, 4, 5, 6, 10, 50, 100, 200, 500, 1000, 2000 liters, or 1, 2, 4, 8, 10, 12, 16, 20, 24, 32, 48, 64 oz., 1, 2, 3, 4, 5, 6, 7, 8, 9, 10, 15, 20, 50, 100, 200, 250 or 500 gallons, or any range or value therein.

For use as a cleaning/disinfecting solution, the concentrate can be diluted with an aqueous solvent as a 0.01–25% (vol.) solution. The concentrate can preferably be diluted in a range of 0.1–250 ml/liter water, such as 0.2 –0.9 (e.g., 0.75), 1–10 (e.g., 5.0), 10–50 (e.g., 25), 50–150 (e.g., 120) or 150–250 (e.g., 250) ml/l water, or any range or value therein. The cleaning/disinfecting properties, when used for cleaning hard surfaces, are found to be enhanced due to the prolonged, pleasant odor and enhanced sense of cleanliness. Preferably, the diluted concentrate is no rinsed with an aqueous solvent after use, in order to enhance the lifetime of the odor or sense of cleanliness.

Having now generally described the invention, the same will be more readily understood through reference to the following example which is provided by way of illustration, and is not intended to be limiting of the present invention.

EXAMPLE 1

Cleaning Concentrate

A formulation of cleaning concentrate was made as a liquid concentrate having:

30% (vol.) of a non-emulsified fragrance, as at least one from the fragrances provided below (each from KAO Corporation S.A., Fragrance Division, Barcelona, Spain);

60% (vol.) of a nonionic or anionic detergent as ICEPAL NP 12 (Rhône-Poulenc, Paris, France); and 10% (vol.) preservative/disinfectant as RHODOQUAT RP 80 (Rhône-Poulenc, Paris, France).

Fragrances: One or more of the following fragrances were used in the formulation of a disinfectant/cleaning concentrate of the present invention.

The fragrance LAVENDER PC 23696 has the following characteristics:

TABLE 1

| Item | Value |
|---|---|
| Appearance | Pale yellow liquid |
| Odor | Lavender, Powdery |
| Specific Gravity (20/20) | 0.965–0.975 |

TABLE 1-continued

| Item | Value |
|---|---|
| Refractive Index (20° C.) | 1.471–1.481 |
| Acid Value mg/g | 15.0 max. |
| Saponification Value mg/g | 135.0–175.0 |
| GLC | FIG. 1 |
| Flash Point | 72° C. P.M.C.C.* |

*Pansky-Martens Closed Cup flash point test.

This fragrance had the gas-liquid chromatography profile presented in FIG. 1.

The fragrance CITRUS PC 23969 had the following characteristics:

TABLE 2

Figure 2:
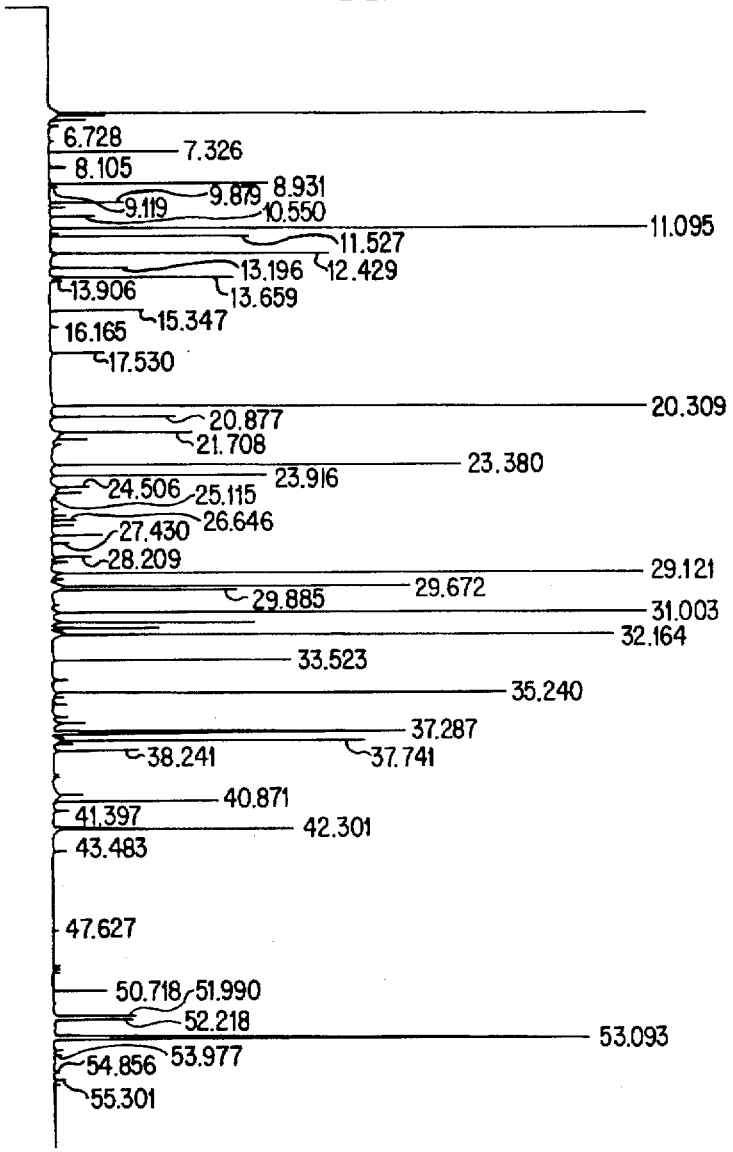
FIG. 2 is a GLC profile for the fragrance CITRON PC 23969.

| Item | Value |
|---|---|
| Appearance | Pale yellow |
| Odor | Lemon, Green |
| Specific Gravity (20/20) | 0.888–0.898 |
| Refractive Index (20° C.) | 1.474–1.484 |
| Acid Value mg/g | 3.0 max. |
| Saponification Value mg/g | 20.0–60.0 |
| GLC | FIG. 2 |
| Flash Point | 71° C. P.M.C.C. |

This fragrance had the gas-liquid chromatography profile presented in FIG. 2.

The fragrance MIMOSA PC 24309 has the following characteristics:

TABLE 3

Figure 3:
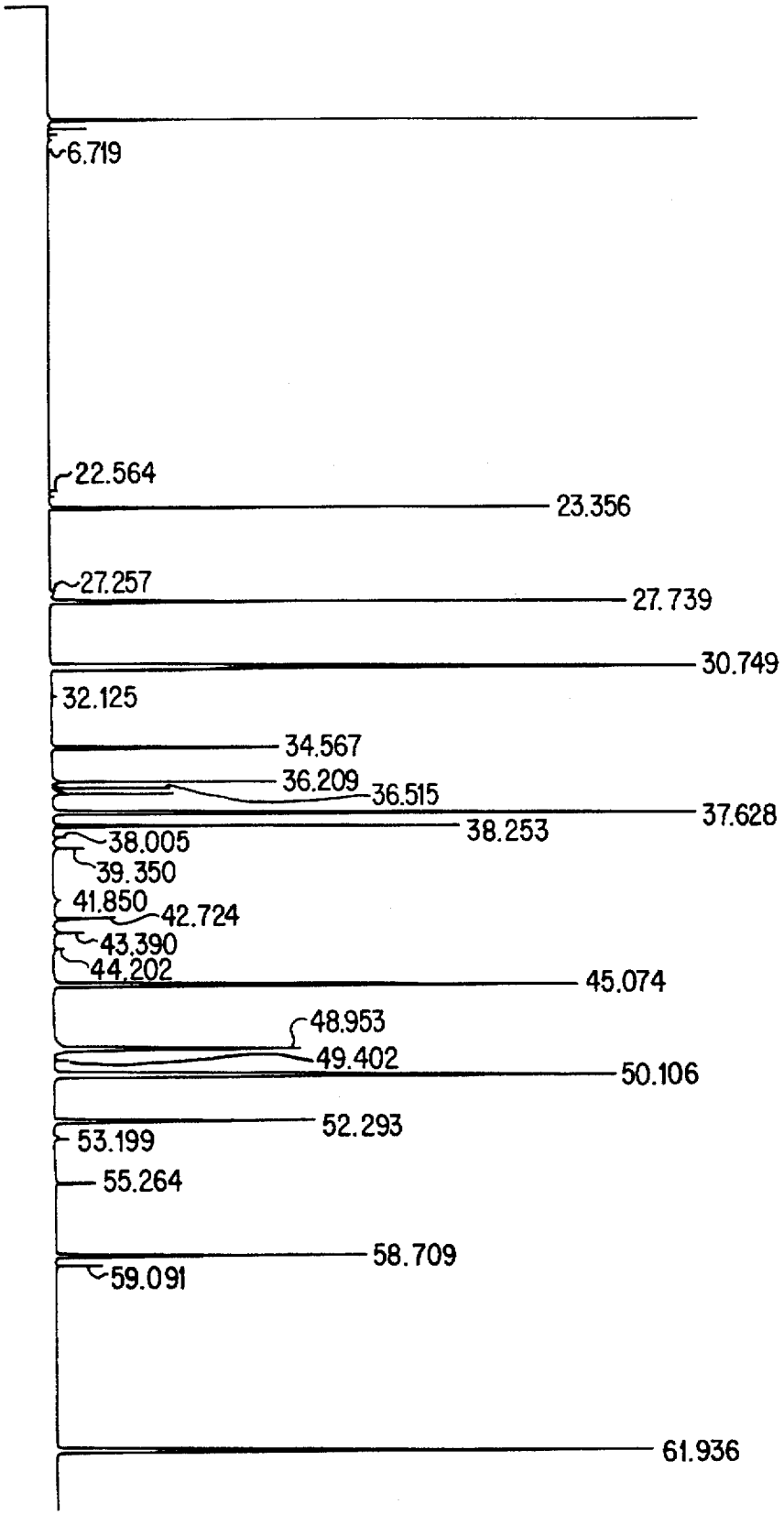
FIG. 3 is a GLC profile for the fragrance MIMOSA PC 24309.

| Item | Value |
|---|---|
| Appearance | Yellow liquid |
| Odor | Floral, Fruity |
| Specific Gravity (20/20) | 1.073–1.083 |
| Refractive Index (20° C.) | 1.529–1.539 |
| Acid Value mg/g | 9.0 max. |
| Saponification Value mg/g | 142.0–182.0 |
| GLC | FIG. 3 |
| Flash Point | 102° C. P.M.C.C. |

This fragrance had the gas-liquid chromatography profile presented in FIG. 3.

The fragrance ZESTY PC 24219 had the following characteristics:

TABLE 4

Figure 4:
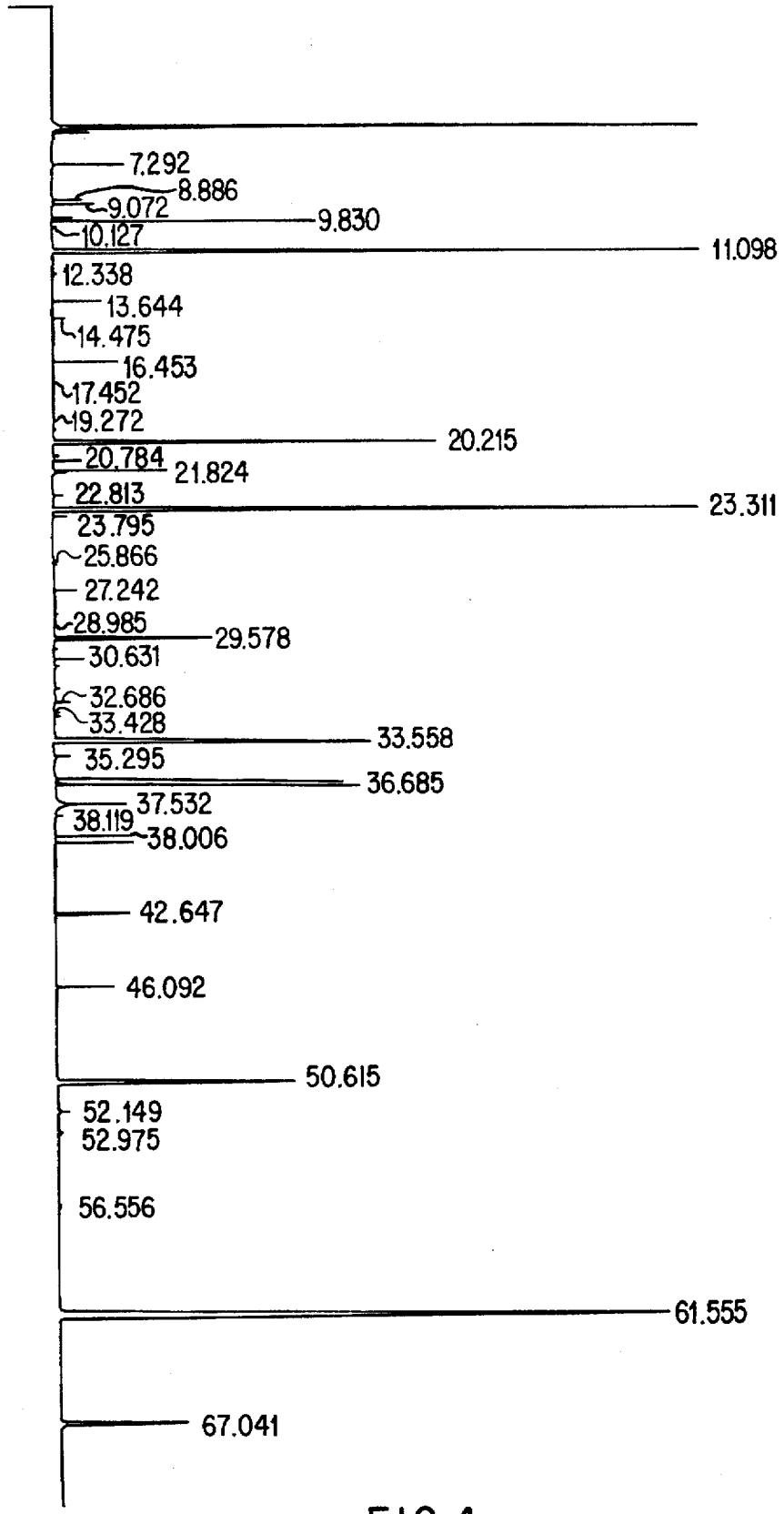
FIG. 4 is a GLC profile for the fragrance ZESTY PC 24219.

| Item | Value |
|---|---|
| Appearance | Yellow liquid |
| Odor | Citrus, Green |
| Specific Gravity (20/20) | 0.902–0.912 |
| Refractive Index (20° C.) | 1.469–1.479 |
| Acid Value mg/g | 2.0 max. |
| Saponification Value mg/g | 35.0–75.0 |
| GLC | FIG. 4 |
| Flash Point | 50° C. P.M.C.C. |

This fragrance had the gas-liquid chromatography profile presented in FIG. 4.

The fragrance VIOLETTE PC 27410 has the following characteristics:

TABLE 5

Figure 5:
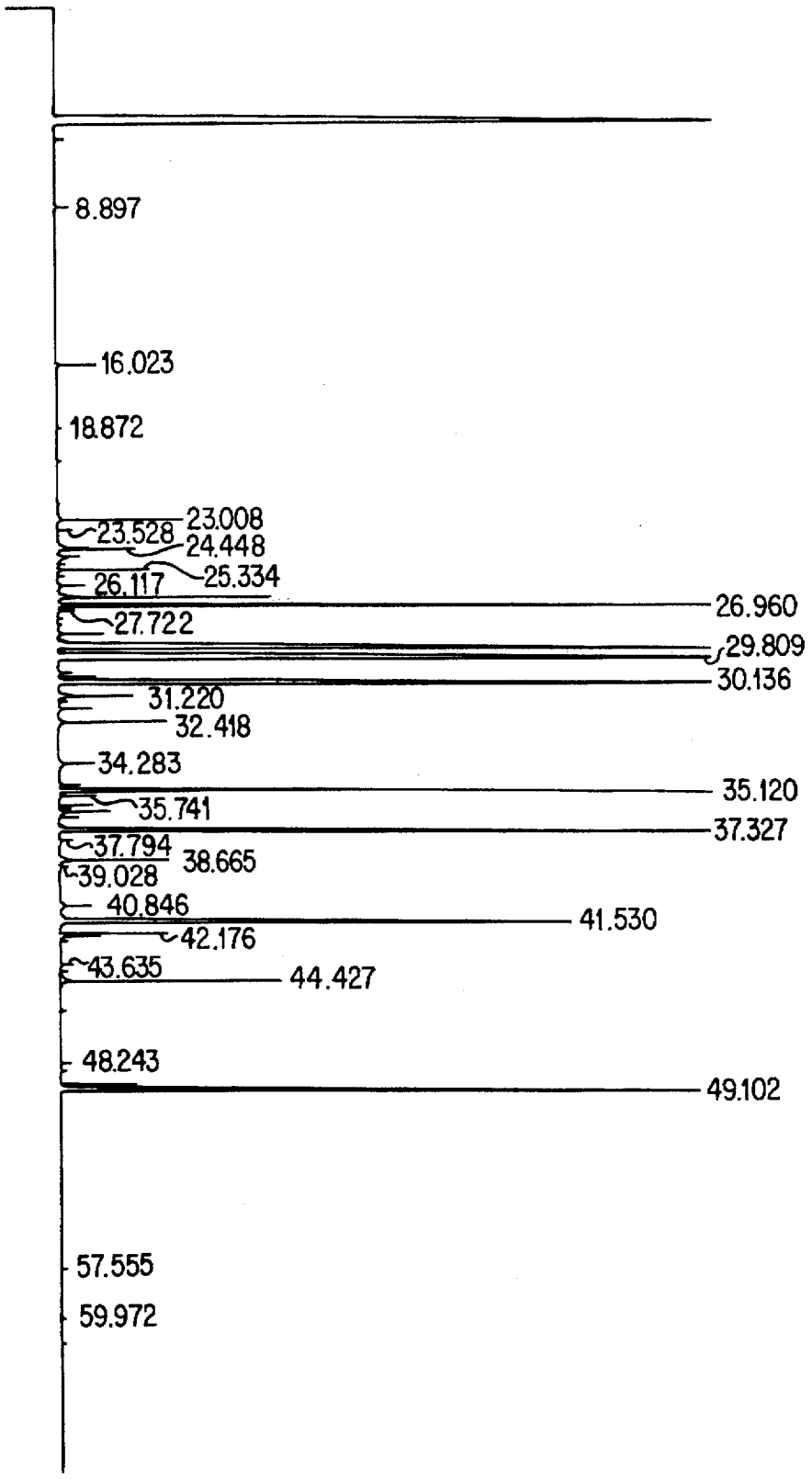
FIG. 5 is a GLC profile for the fragrance VIOLETTE PC 27410.

| Item | Value |
|---|---|
| Appearance | Pale yellow liquid |
| Odor | Floral, Violet |
| Specific Gravity (20/20) | 0.965–0.975 |
| Refractive Index (20° C.) | 1.483–1.493 |
| Acid Value mg/g | 2.0 max. |
| Saponification Value mg/g | 151.0–191.0 |
| GLC | FIG. 5 |
| Flash Point | 103° C. P.M.C.C. |

This fragrance had the gas-liquid chromatography profile presented in FIG. 5.

The fragrance SPITZ PC 24736 had the following characteristics:

TABLE 6

Figure 6:
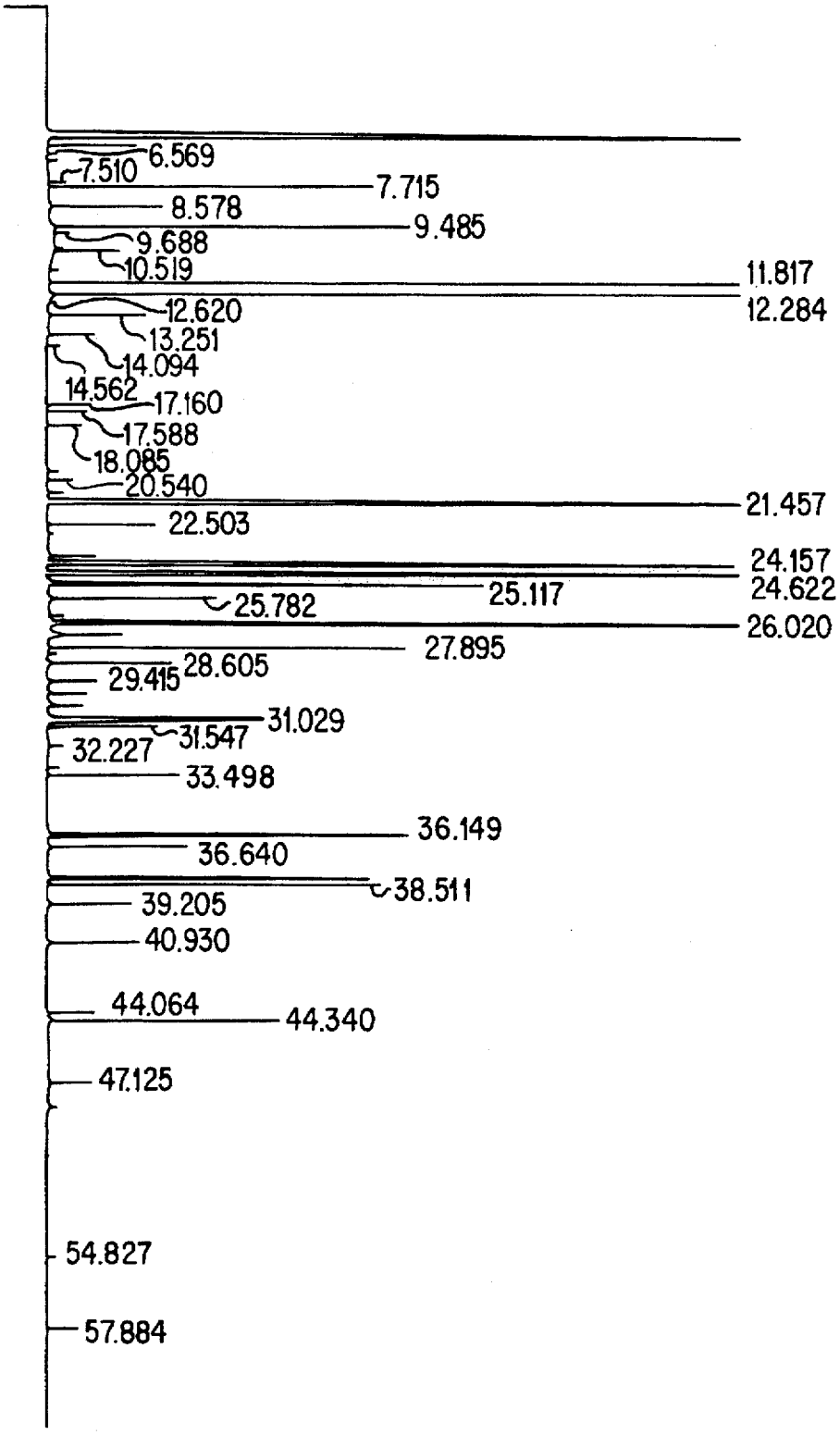
FIG. 6 is a GLC profile for the fragrance SPITZ PC 24736.

| Item | Value |
|---|---|
| Appearance | Yellow liquid |
| Odor | Aromatic, Green, Woody |
| Specific Gravity (20/20) | 0.912–0.922 |
| Refractive Index (20° C.) | 1.451–1.461 |
| Acid Value mg/g | 5.0 max. |
| Saponification Value mg/g | 40.0–80.0 |
| GLC | FIG. 6 |
| Flash Point | 67° C. P.M.C.C. |

This fragrance had the gas-liquid chromatography profile presented in FIG. 6.

The fragrance POMME I PC 25003 has the following characteristics:

TABLE 7

Figure 7:
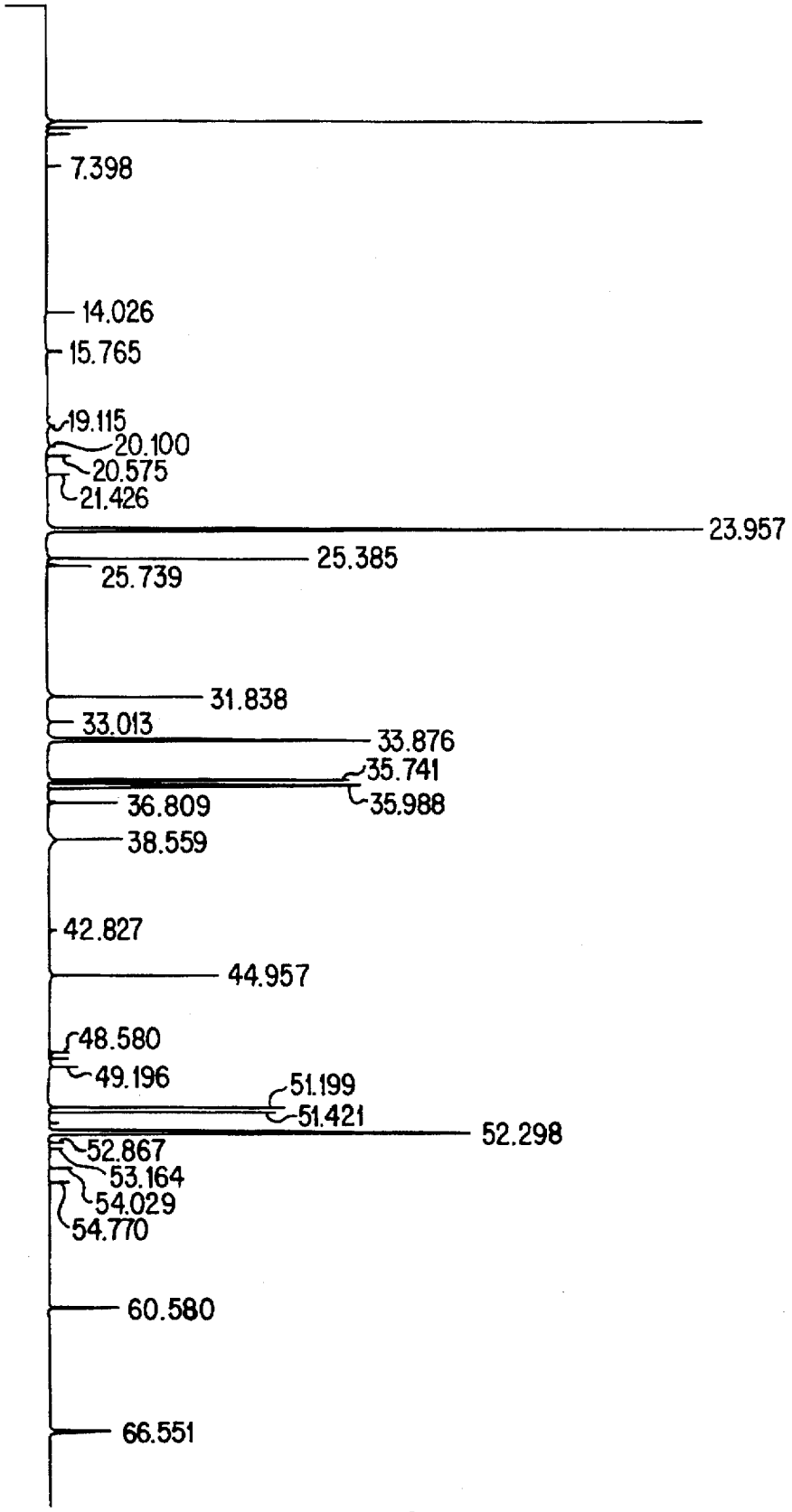
FIG. 7 is a GLC profile for the fragrance POMME I PC 25003.

| Item | Value |
|---|---|
| Appearance | Pale yellow liquid |
| Odor | Fruity, Apple |
| Specific Gravity (20/20) | 0.994–1.004 |
| Refractive Index (20° C.) | 1.464–1.474 |
| Acid Value mg/g | 1.0 max. |
| Saponification Value mg/g | 74.0–114.0 |
| GLC | FIG. 7 |
| Flash Point | 100° C. P.M.C.C. |

This fragrance had the gas-liquid chromatography profile presented in FIG. 7.

The fragrance CHYPRE PC 24447 had the following characteristics:

TABLE 8

Figure 8:
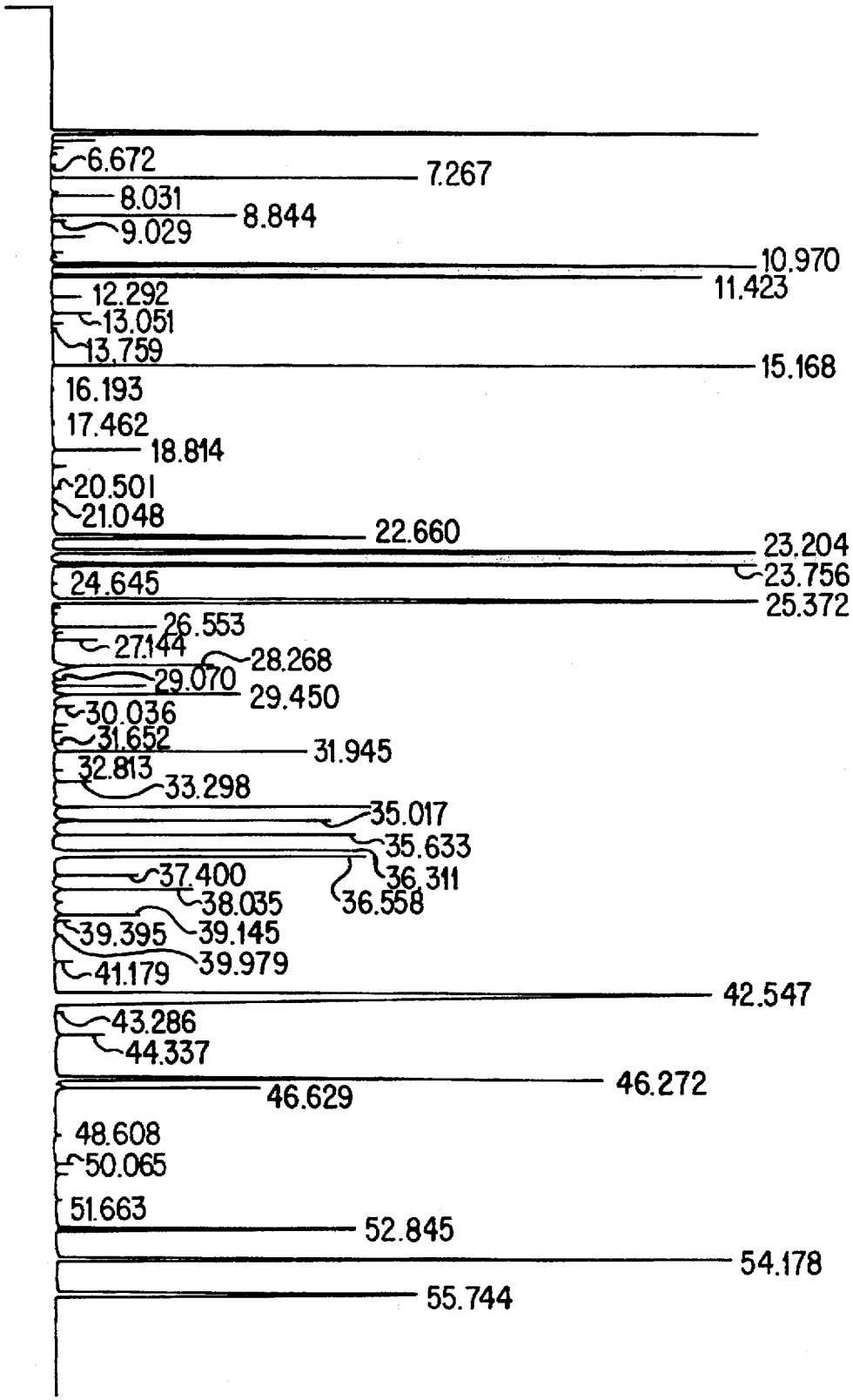
FIG. 8 is a GLC profile for the fragrance CHYPRE PC 24447.

| Item | Value |
|---|---|
| Appearance | Yellow liquid |
| Odor | Pine, Green |
| Specific Gravity (20/20) | 0.946–0.956 |
| Refractive Index (20° C.) | 1.474–1.484 |
| Acid Value mg/g | 3.0 max. |
| Saponification Value mg/g | 71.0–111.0 |
| GLC | FIG. 8 |
| Flash Point | 73° C. P.M.C.C. |

This fragrance had the gas-liquid chromatography profile presented in FIG. 8.

The fragrance GUM II PC 27038 has the following characteristics:

TABLE 9

Figure 9:
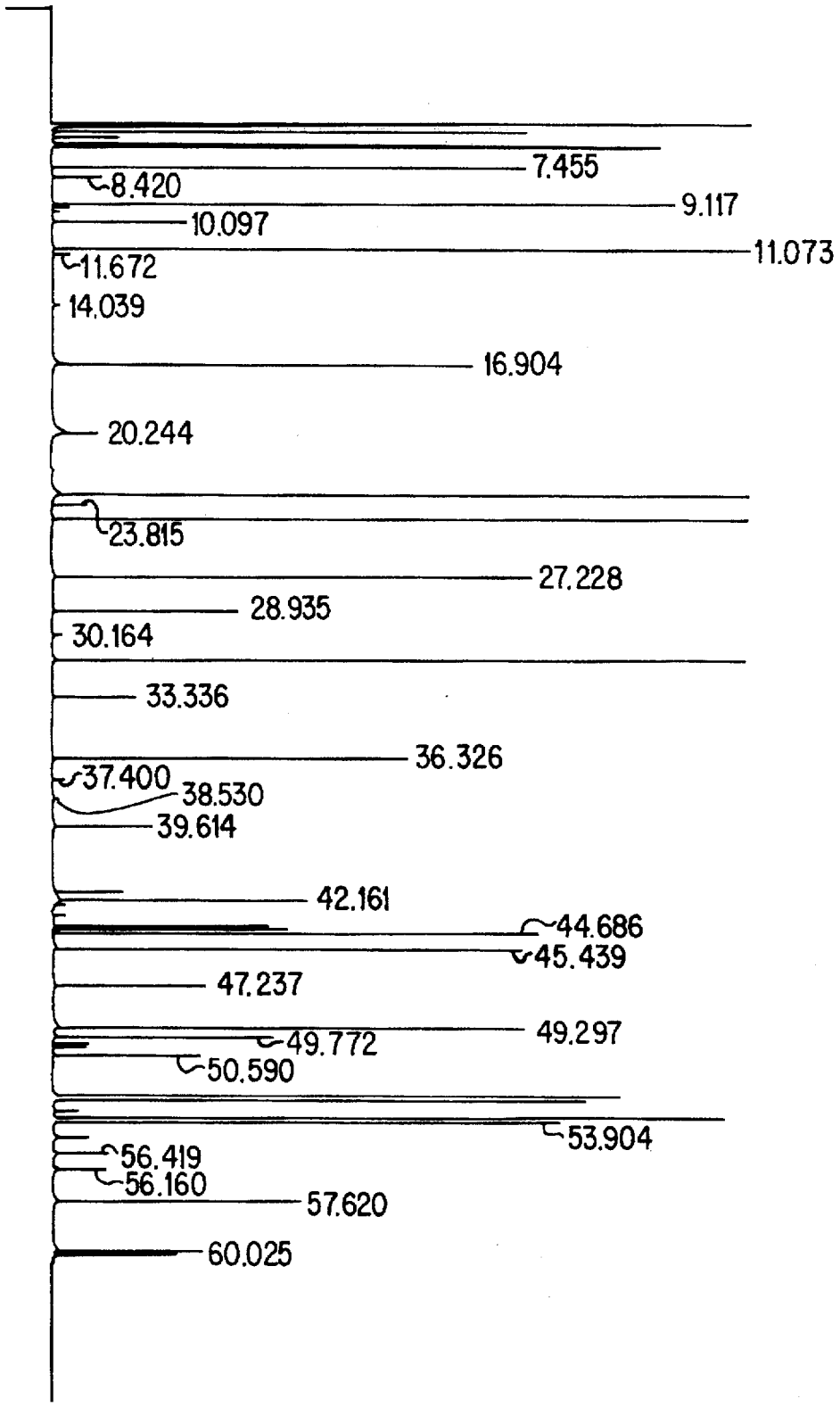
FIG. 9 is a GLC profile for the fragrance GUM II PC 27038.

| Item | Value |
|---|---|
| Appearance | Yellow liquid |
| Odor | Tutti Fruitti |
| Specific Gravity (20/20) | 0.967–0.977 |
| Refractive Index (20° C.) | 1.483–1.493 |
| Acid Value mg/g | 27.0 max. |
| Saponification Value mg/g | 206.0–246.0 |
| GLC | FIG. 9 |
| Flash Point | 35° C. T.C.C.* |

*Tag-Closed Cup flash point test.

This fragrance had the gas-liquid chromatography profile presented in FIG. 9.

The fragrance ZESTE PC 24449 had the following characteristics:

TABLE 10

Figure 10:
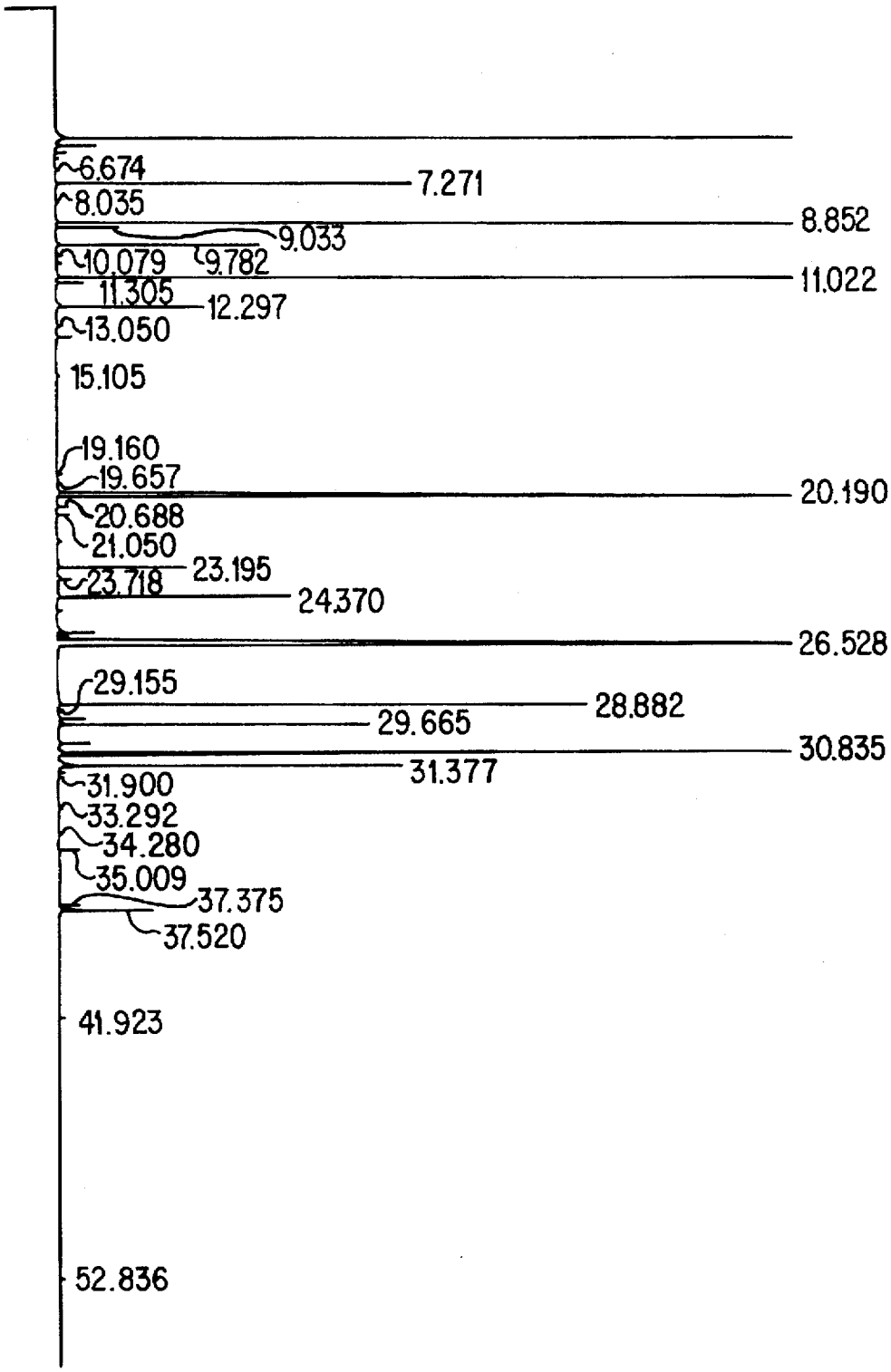
FIG. 10 is a GLC profile for the fragrance ZESTE PC 24449.

| Item | Value |
|---|---|
| Appearance | Yellow liquid |
| Odor | Citrus |
| Specific Gravity (20/20) | 0.887–0.897 |
| Refractive Index (20° C.) | 1.454–1.464 |
| Acid Value mg/g | 2.0 max. |
| Saponification Value mg/g | 30.0 max |
| GLC | FIG. 10 |
| Flash Point | 53° C. T.C.C. |

This fragrance had the gas-liquid chromatography profile presented in FIG. 10.

The fragrance ARDANTE PC 24448 has the following characteristics:

TABLE 11

Figure 11:
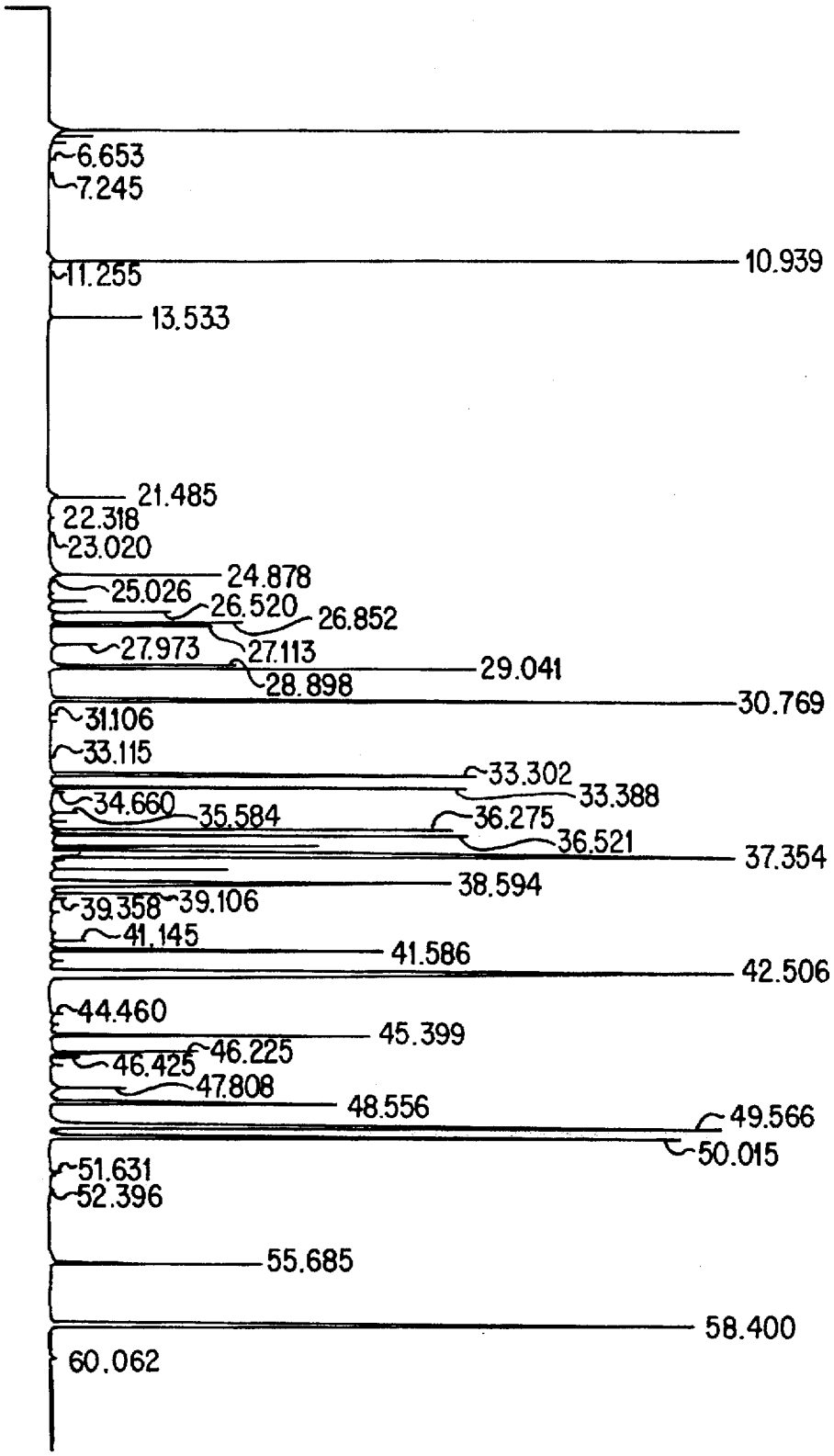
FIG. 11 is a GLC profile for the fragrance ARDANTE PC 24448.

| Item | Value |
|---|---|
| Appearance | Pale yellow liquid |
| Odor | Floral, Aldehydic, Oriental |
| Specific Gravity (20/20) | 1.020–1.030 |
| Refractive Index (20° C.) | 1.502–1.512 |
| Acid Value mg/g | 6.0 max. |
| Saponification Value mg/g | 75.0–115.0 |
| GLC | FIG. 11 |
| Flash Point | 91° C. P.M.C.C. |

This fragrance had the gas-liquid chromatography profile presented in FIG. 11.

The fragrance VANILLAROME PC 24217 had the following characteristics:

TABLE 12

Figure 12:
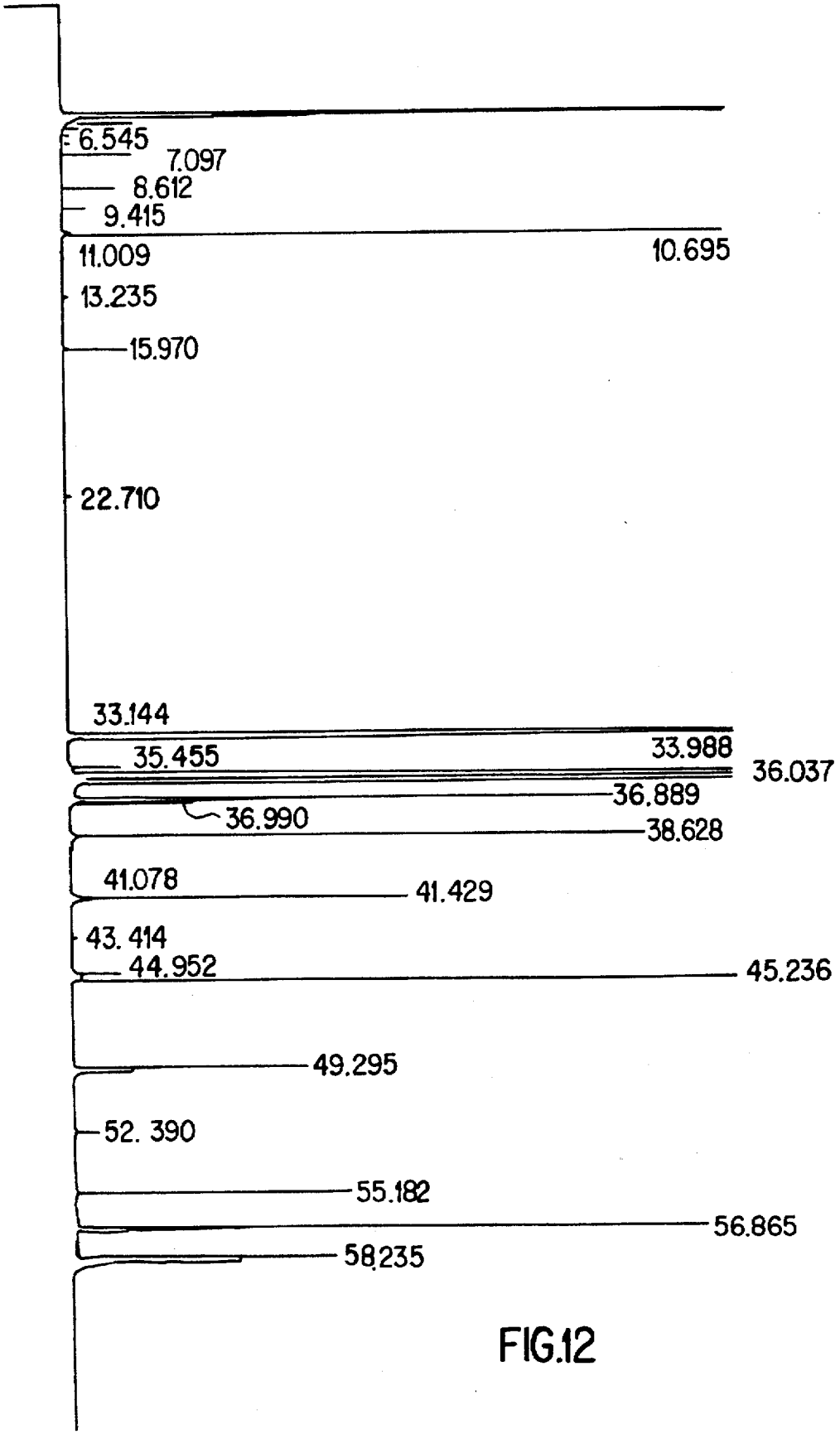
FIG. 12 is a GLC profile for the fragrance VANILLAROME PC 24217.

| Item | Value |
|---|---|
| Appearance | Pale yellow liquid |
| Odor | Fruity, Vanilla, Sweet |
| Specific Gravity (20/20) | 1.039–1.049 |
| Refractive Index (20° C.) | 1.464–1.474 |
| Acid Value mg/g | 91.0 max. |
| Saponification Value mg/g | 63.0–103.0 |
| GLC | FIG. 12 |
| Flash Point | 93° C. P.M.C.C. |

This fragrance had the gas-liquid chromatography profile presented in FIG. 12.

The fragrance PAOLA PC 24310 has the following characteristics:

TABLE 13

Figure 13:
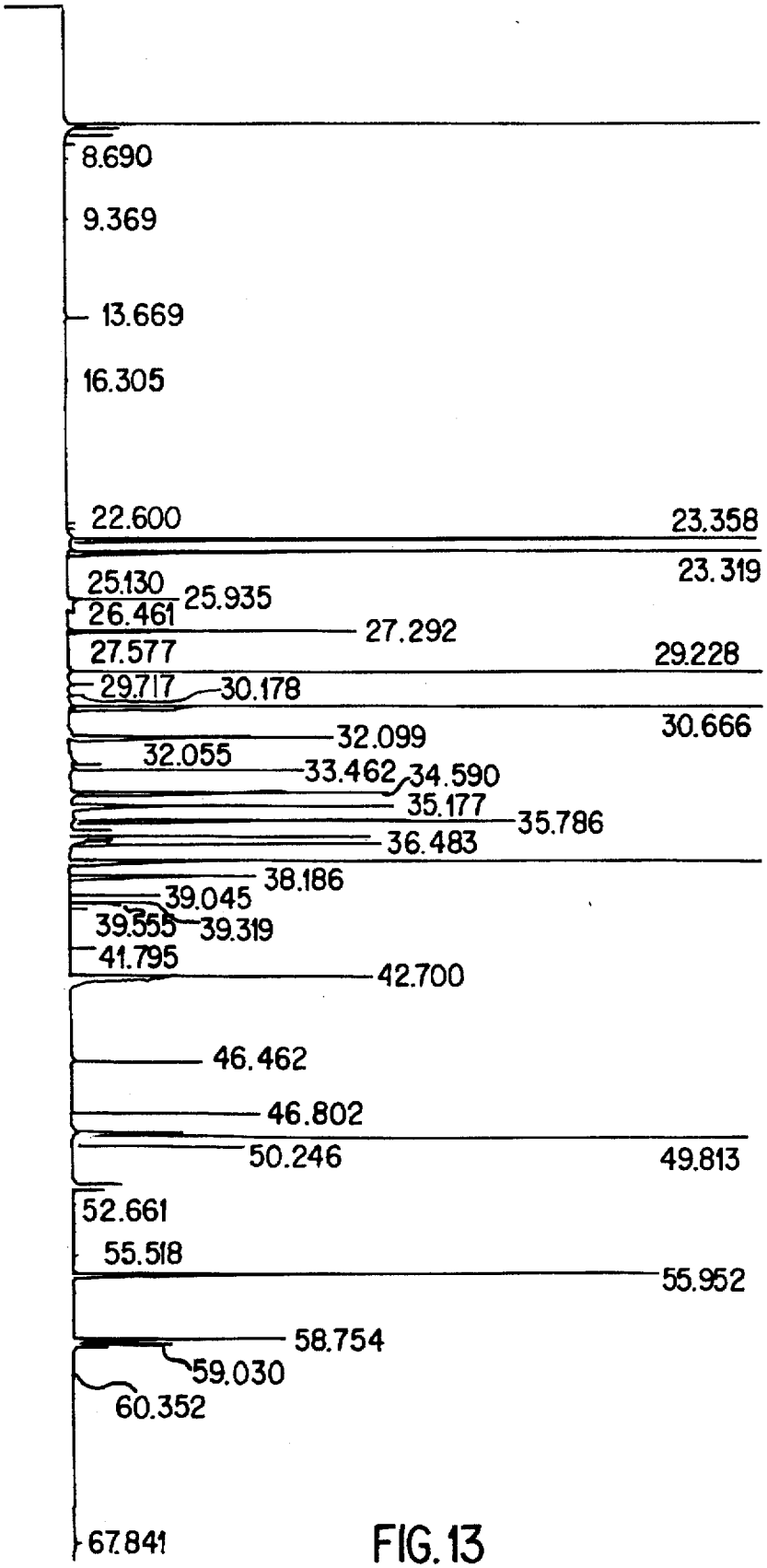
FIG. 13 is a GLC profile for the fragrance PAOLA PC 24310.

| Item | Value |
|---|---|
| Appearance | Yellow liquid |
| Odor | Floral, Aldehydic, Amber |
| Specific Gravity (20/20) | 1.010–1.020 |
| Refractive Index (20° C.) | 1.500–1.510 |
| Acid Value mg/g | 18.0 max. |
| Saponification Value mg/g | 100.0–140.0 |
| GLC | FIG. 13 |
| Flash Point | 102° C. P.M.C.C. |

This fragrance had the gas-liquid chromatography profile presented in FIG. 13.

The fragrance EUCALYPTUS PC 24583 had the following characteristics:

TABLE 14

Figure 14:
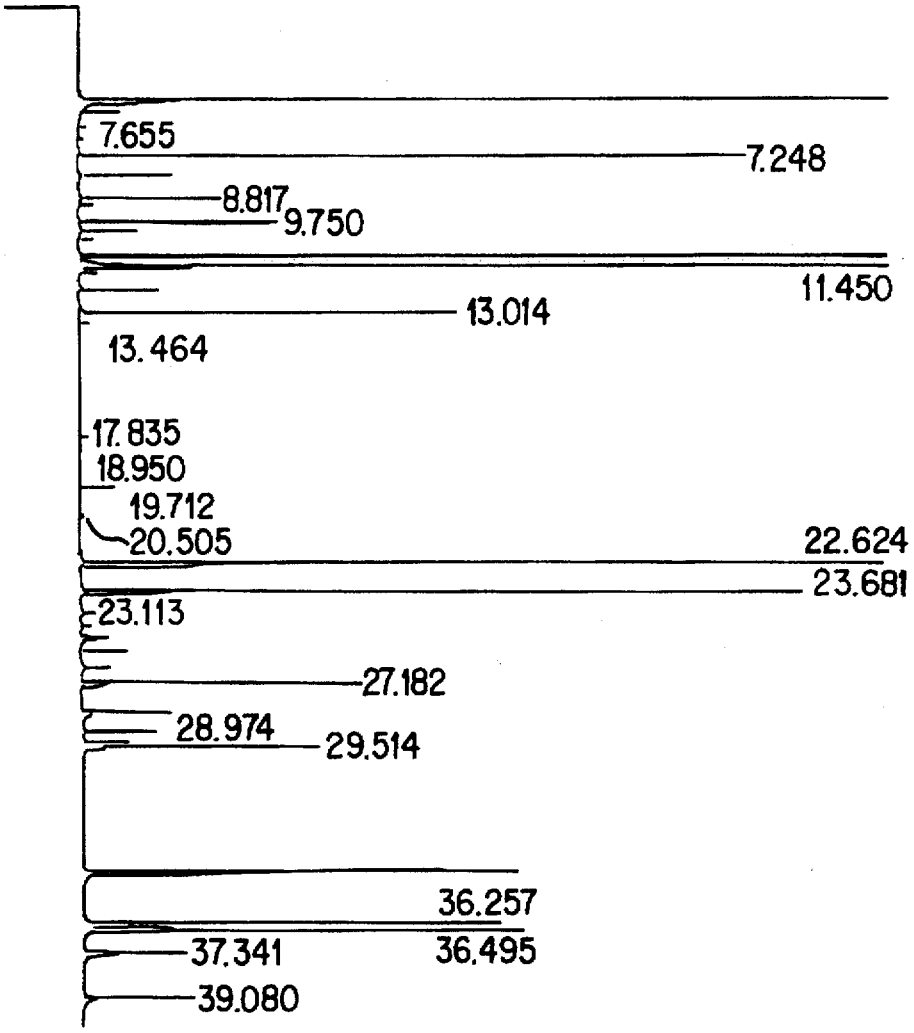
FIG. 14 is a GLC profile for the fragrance EUCALYPTUS PC 24583.

| Item | Value |
|---|---|
| Appearance | Clear liquid |
| Odor | Eucalyptus |
| Specific Gravity (20/20) | 0.932–0.942 |
| Refractive Index (20° C.) | 1.453–1.463 |
| Acid Value mg/g | 1.0 max. |
| Saponification Value mg/g | 40.0 max |
| GLC | FIG. 14 |
| Flash Point | 52° C. T.C.C. |

This fragrance had the gas-liquid chromatography profile presented in FIG. 14.

The fragrance NECTAR PE 24180 has the following characteristics:

TABLE 15

Figure 15:
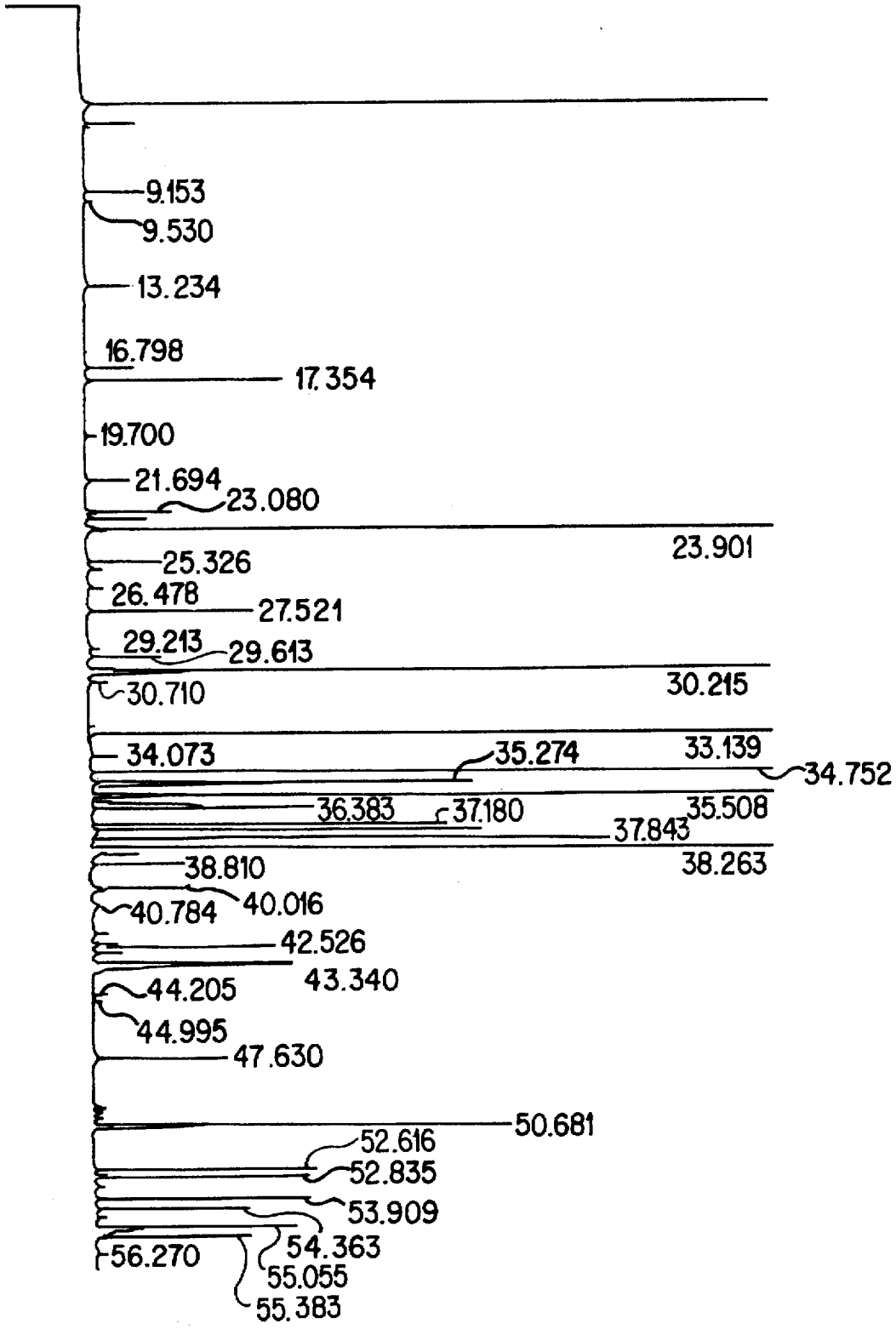
FIG. 15 is a GLC profile for the flagrance NECTAR PC 24180.

| Item | Value |
|---|---|
| Appearance | Clear liquid |
| Odor | Fruity, Peach, Green, Floral |
| Specific Gravity (20/20) | 0.960–0.970 |
| Refractive Index (20° C.) | 1.477–1.487 |
| Acid Value mg/g | 2.0 max. |
| Saponification Value mg/g | 72.0–112.0 |
| GLC | FIG. 15 |
| Flash Point | 93° C. P.M.C.C. |

This fragrance had the gas-liquid chromatography profile presented in FIG. 15.

The fragrance MUGUET PC 24311 has the following characteristics:

TABLE 16

Figure 16:
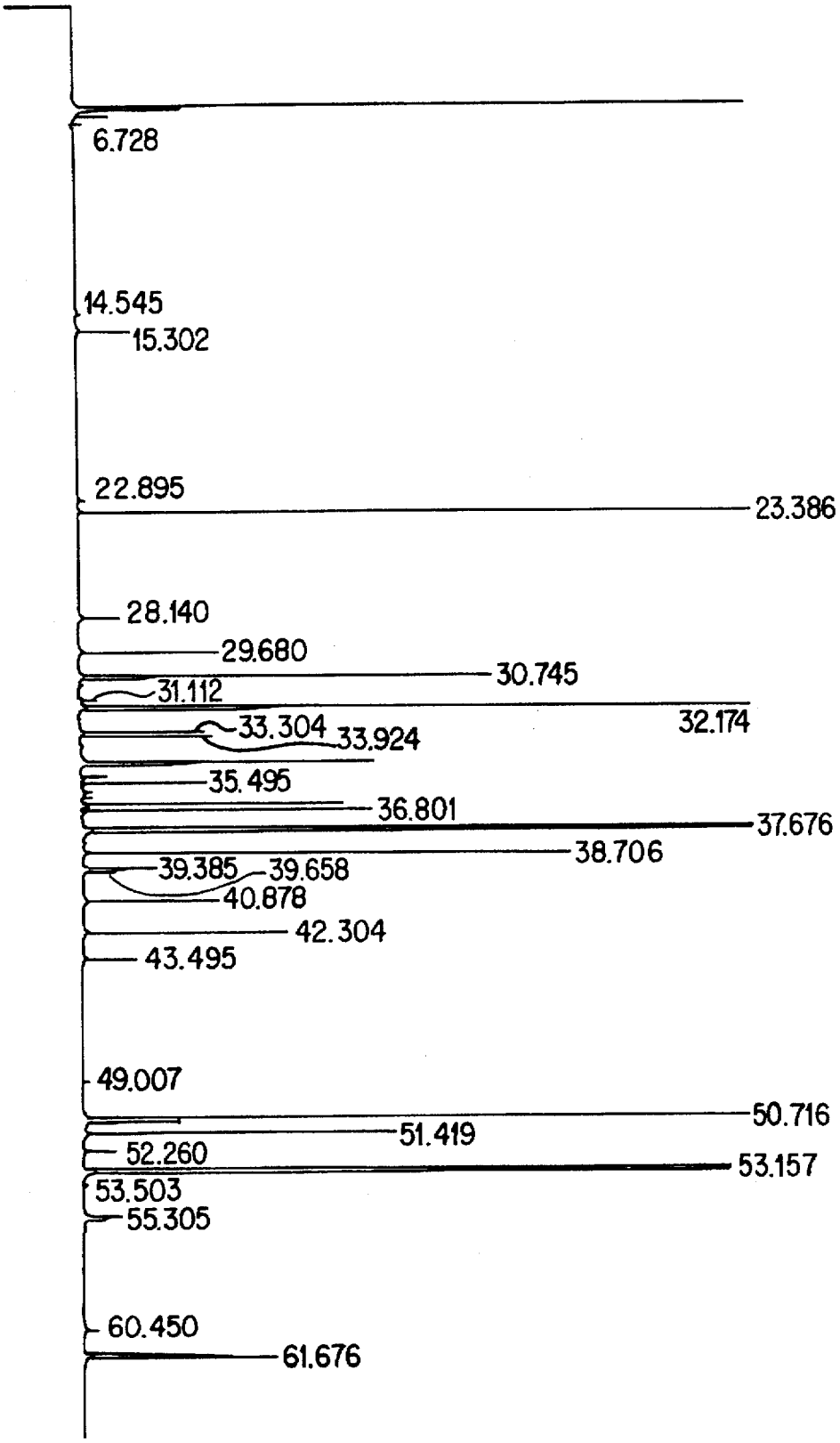
FIG. 16 is a GLC profile for the flagrance MUGUET PC 24311.

| Item | Value |
|---|---|
| Appearance | Pale Yellow liquid |
| Odor | Floral, Miguet |
| Specific Gravity (20/20) | 0.976–0.986 |
| Refractive Index (20° C.) | 1.495–1.505 |
| Acid Value mg/g | 2.0 max. |
| Saponification Value mg/g | 40.0–80.0 |
| GLC | FIG. 16 |
| Flash Point | 104° C. P.M.C.C. |

This fragrance had the gas-liquid chromatography profile presented in FIG. 16.

The fragrance GUM PC 24446 has the following characteristics:

TABLE 17

Figure 17:
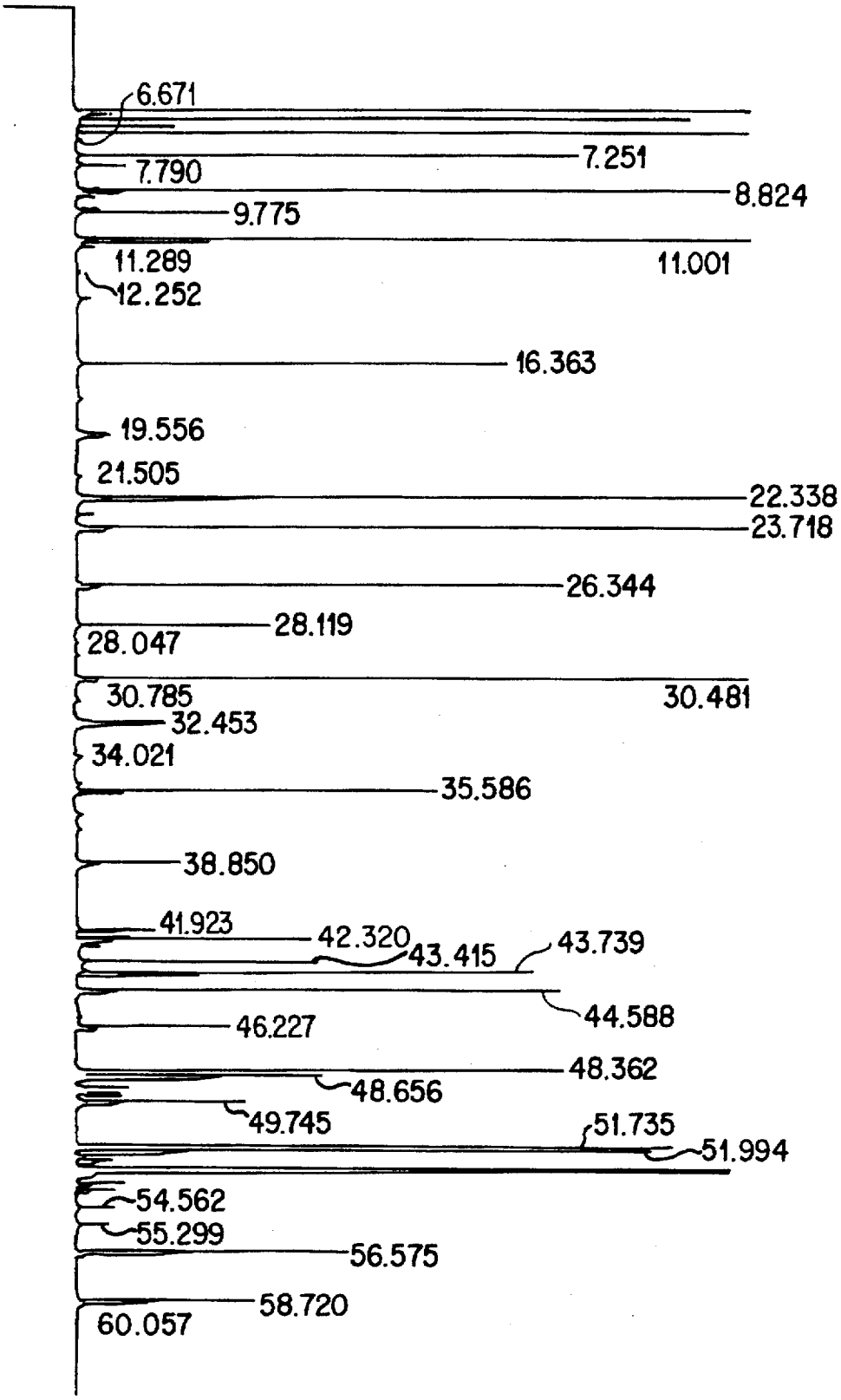
FIG. 17 is a GLC profile for the flagrance GUM PC 24446.

| Item | Value |
|---|---|
| Appearance | Yellow liquid |
| Odor | Fruity, Strawberry |
| Specific Gravity (20/20) | 0.969–0.979 |
| Refractive Index (20° C.) | 1.481–1.491 |
| Acid Value mg/g | 30.0 max. |
| Saponification Value mg/g | 205.0–245.0 |
| GLC | FIG. 17 |
| Flash Point | 35° C. T.C.C. |

This fragrance had the gas-liquid chromatography profile presented in FIG. 17.

The fragrance GRANY PC 24453 had the following characteristics:

TABLE 18

Figure 18:
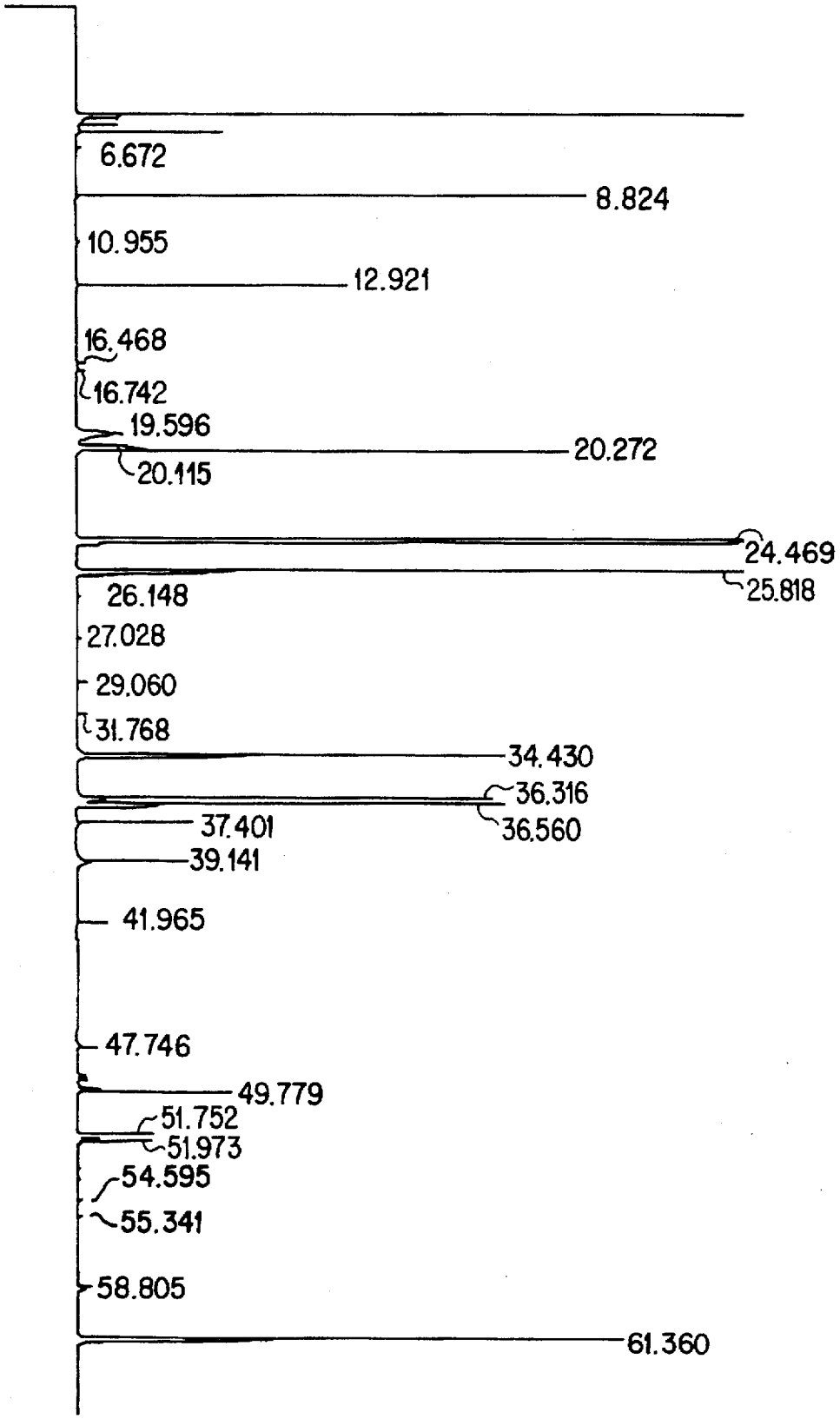
FIG. 18 is a GLC profile for the fragrance GRANY PC 24453.

| Item | Value |
|---|---|
| Appearance | Clear liquid |
| Odor | Fruity apple |
| Specific Gravity (20/20) | 0.963–0.973 |
| Refractive Index (20° C.) | 1.496–1.506 |
| Acid Value mg/g | 1.0 max. |
| Saponification Value mg/g | 123.0–163.0 |
| GLC | FIG. 18 |
| Flash Point | 81° C. P.M.C.C. |

This fragrance had the gas-liquid chromatography profile presented in FIG. 18.

The fragrance CITRONELLE PC 24584 has the following characteristics:

TABLE 19

Figure 19:
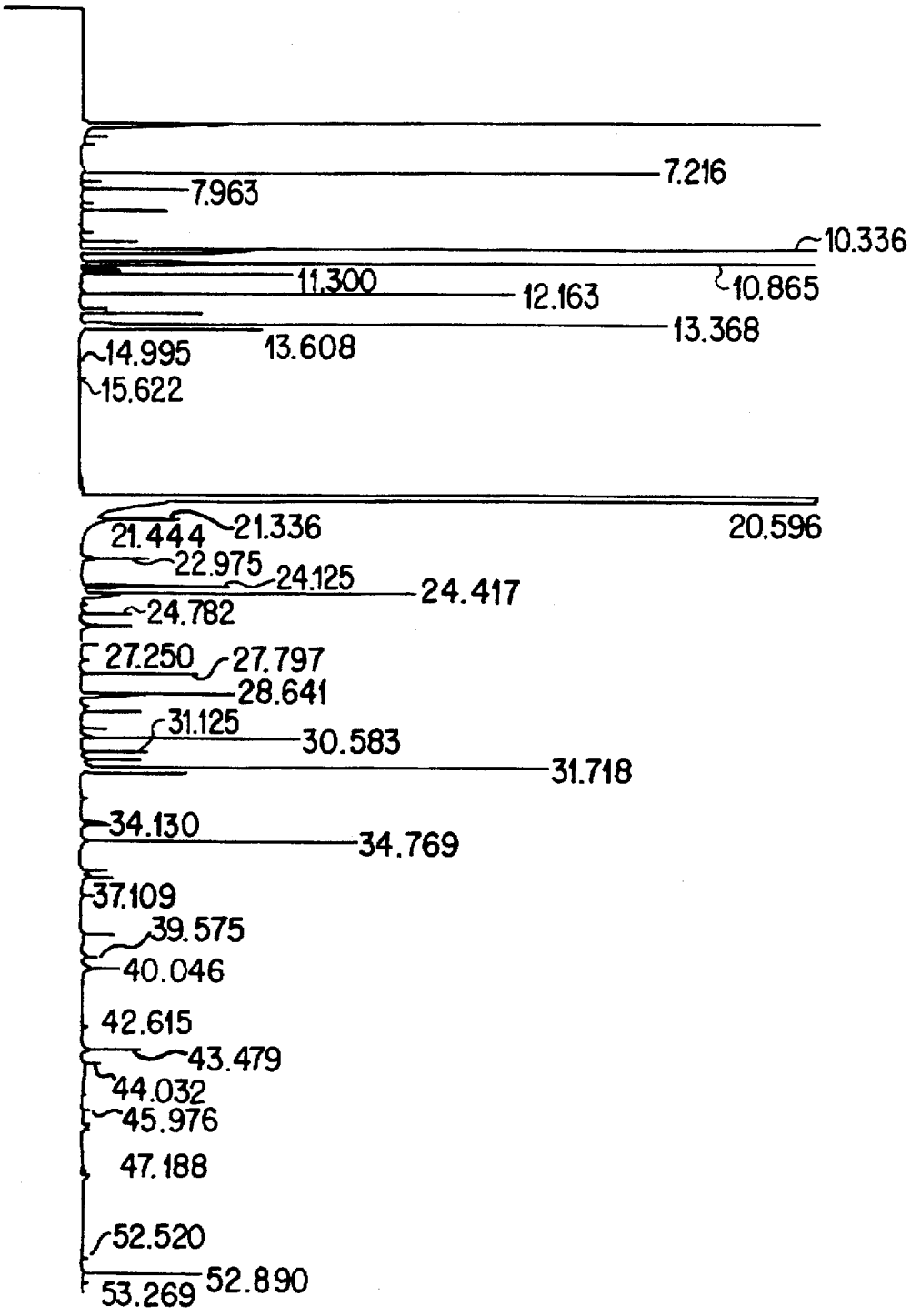
FIG. 19 is a GLC profile for the flagrance CITRONELLE PC 24584.

| Item | Value |
|---|---|
| Appearance | Pale yellow liquid |
| Odor | Citronella, Pine, Aldehydic |
| Specific Gravity (20/20) | 0.863–0.873 |
| Refractive Index (20° C.) | 1.457–1.467 |
| Acid Value mg/g | 3.0 max. |
| Saponification Value mg/g | 36.0 max. |
| GLC | FIG. 19 |
| Flash Point | 63° C. P.M.C.C. |

This fragrance had the gas-liquid chromatography profile presented in FIG. 19.

The fragrance JASMIN PC 25512 had the following characteristics:

TABLE 20

Figure 20:
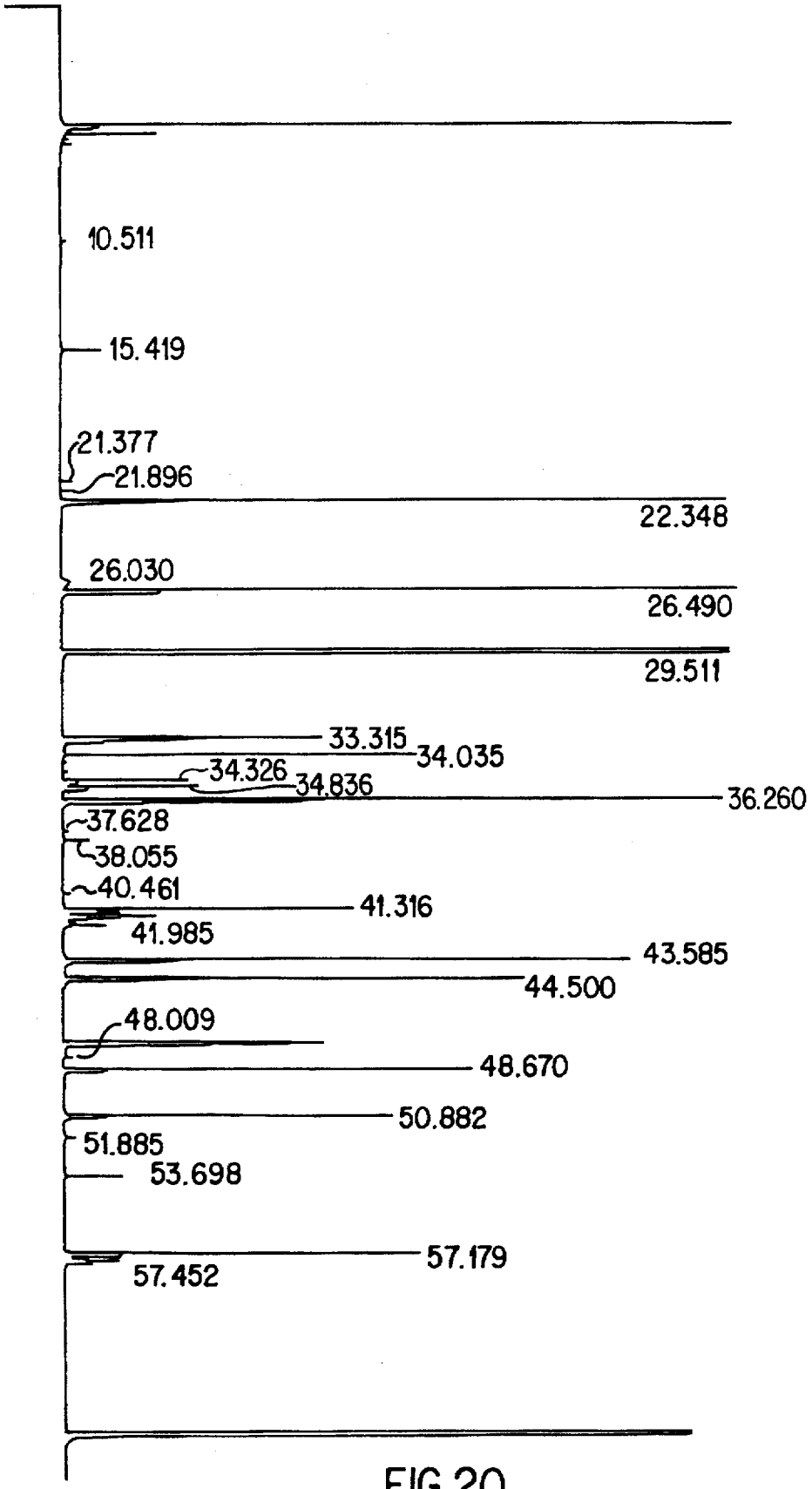
FIG. 20 is a GLC profile for the fragrance JASMIN PC 25512.

| Item | Value |
|---|---|
| Appearance | Yellow liquid |
| Odor | Floral, Fruity |
| Specific Gravity (20/20) | 0.070–0.080 |
| Refractive Index (20° C.) | 1.529–1.539 |
| Acid Value mg/g | 9.0 max. |
| Saponification Value mg/g | 160.0–200.0 |
| GLC | FIG. 20 |
| Flash Point | 106° C. P.M.C.C. |

This fragrance had the gas-liquid chromatography profile presented in FIG. 20.

The fragrance CITRONADE PC 27039 has the following characteristics:

TABLE 21

Figure 21:
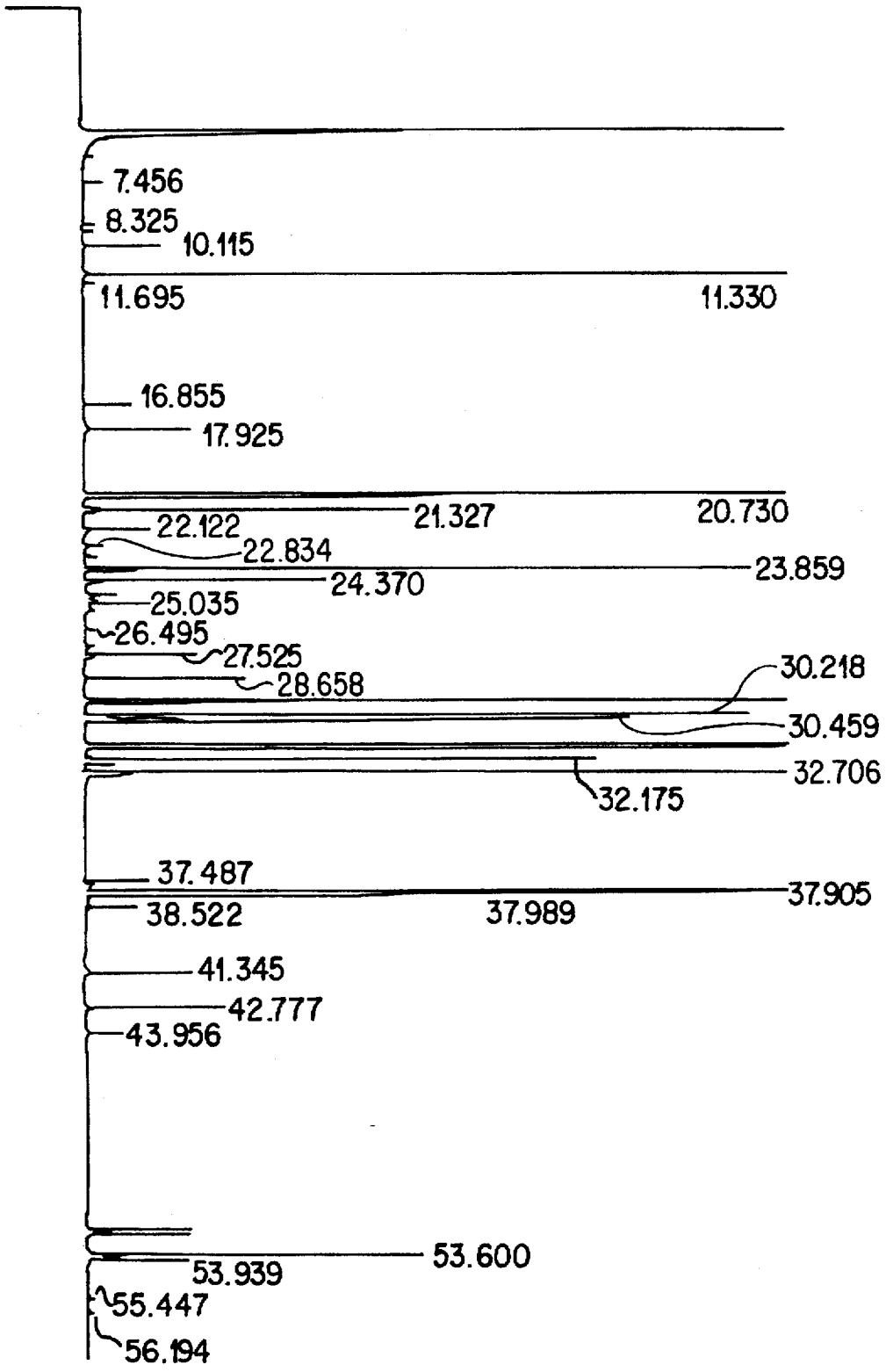
FIG. 21 is a GLC profile for the flagrance CITRONADE PC 27039.

| Item | Value |
|---|---|
| Appearance | Yellow liquid |
| Odor | Citrus, Green, Jasmin, Musky |
| Specific Gravity (20/20) | 0.884–0.894 |
| Refractive Index (20° C.) | 1.471–1.481 |
| Acid Value mg/g | 2.0 max. |
| Saponification Value mg/g | 19.0–59.0 |
| GLC | FIG. 21 |
| Flash Point | 73° C. P.M.C.C. |

This fragrance had the gas-liquid chromatography profile presented in FIG. 21.

Detergent. The nonionic detergent, IGEPAL NP 12 (Rhône-Poulenc, Paris, France) includes as an active ingredient a nonylphenol ethoxy ether (CAS Reg. No. 9016-45-9). The characteristics of this detergent are present in the following table 22:

TABLE 22

| Detergent Characteristics | |
|---|---|
| Appearance at 25° C. | Clear liquid |
| Color (Hazel) | 150 max. |
| pH (aq. sol. 1%) | 5–7.7 |
| Flash point (°C.) (sol. aq. 1%) | 77–85 |
| Water (%) (K. Fischer) | 0.5 max. |
| Character | Non-ionic |
| Active ingredients (%) | 98–100 |
| Density (g/cm$^3$) | 1.07 |
| Melting point (°C.) | 14 |
| Boiling point (°C.) (NFT 60118) | >150 |
| HLB | 13.9 |

Detergent Foaming:
Volume of Foam in ml (ISO) (solution at 1 g/l):

| Temp | 30 sec. | 3 min. | 5 min |
|---|---|---|---|
| T. 20° C. | 250 | 240 | 220 |
| A 50° C. | 240 | 200 | 180 |

Preservative. The preservative/disinfectant RHODOQUAT RP 80 (Rhône-Poulenc, Paris, France) includes as an active ingredient a quaternary ammonium compound, dialkylbenzyldimethyl ammonium chloride (CAS Reg. No. 61789-71-7). The characteristics of this detergent are present in the following table 23:

TABLE 23

| Preservative/Disinfectant Characteristics | |
|---|---|
| Activity (%) | 79–81 |
| Free amines + amine salts | 2.5 max |
| pH (aq. sol. 2%) | 5–8 |
| Character | Cationic |
| Appearance at 20° C. | Colorless viscous liquid |
| Solubility | Soluble in water, alcohol, acetone, glycerol, glycols; insoluble in ether, chloroform, trichloroethylene, benzene, mineral oil |
| Dilution for Biocide (ppm) (BS: 6471) | 250 |
| Boiling point (°C.) (PMCC) | >70 |

Method of Making.

The concentrate was made by using the steps of:

(a) heating the detergent IGEPAL NP 12 ( to be about 60% (vol.) of total mixture), such that it is liquefied (at about 40°–50° C.);

(b) mixing in the preservative RHODAQUAT RP 80 (to be about 10% (vol.) of total mixture);

(c) adding the perfume as about 30% (vol.) of the total mixture:

(d) letting the mixture stand until the mixture is homogeneous.

This cleaning concentrate was provided undiluted, or diluted with water as a 12–25% (vol.) solution. The concentrate was diluted in a range of 10–40 ml/gallon water. The cleaning/disinfecting properties, when used for cleaning hard surfaces, were found to be enhanced due to the prolonged, pleasant odor and enhanced sense of cleanliness.

EXAMPLE 2

Disinfecting Concentrate

A formulation of disinfecting concentrate is made as a liquid concentrate as in Example 1, except that 27–30% (vol.) of a non-emulsified fragrance, 50–60% (vol.) of a nonionic detergent as IGEPAL NP 12 (Rhône-Poulenc, Paris, France), and 12–20% (vol.) cationic preservative/disinfectant is used as RHODOQUAT RP 80 (Rhône-Poulenc, Paris, France).

This disinfecting concentrate is found to be suitable for use as a commercial disinfecting solution, expected to have enhanced cleaning/disinfecting properties, when used for cleaning hard surfaces, due to the prolonged, pleasant odor and enhanced sense of cleanliness.

All references cited herein are entirely incorporated herein by reference, including all data, tables, figures, text and references presented in the cited references. Reference to known method steps, conventional methods steps, known methods or conventional methods is not in any way an admission that any aspect, description or embodiment of the present invention is disclosed, taught or suggested in the relevant art.

The description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. It is to be understood that the phraseology or terminology herein is for the purpose of description and not of limitation, such that the terminology or phraseology is to be interpreted by the skilled artisan in light of the teachings and guidance presented herein, in combination with the knowledge of one of ordinary skill in the relevant arts.

What is claimed is:

1. A cleaning concentrate for use on hard surfaces, comprising:

(a) 20–40% by volume of at least one non-emulsified liquid perfume selected from the group consisting of quaternary ammonium halides;

(b) 30–70% by volume of at least one non-ionic detergent and (c) 5–20% by volume of at least one cationic preservative, wherein the ratio of detergent to perfume is 0.75–3.5 by volume percent.

2. A cleaning concentrate according to claim 1, wherein said non-emulsified perfume is 25–40% by volume.

3. A cleaning concentrate according to claim 2, wherein said perfume is 30% by volume.

4. A cleaning concentrate according to claim 1, wherein said detergent is 40–70% by volume.

5. A cleaning concentrate according to claim 3, wherein said nonionic detergent is 60% by volume.

6. A cleaning concentrate according to claim 1, wherein said preservative is 5–12% by volume and provides preservative activity for said cleaning concentrate.

7. A cleaning concentrate according to claim 1, wherein said preservative is 12–20% by volume and provides disinfecting activity for said cleaning concentrate.

8. A cleaning concentrate according to claim 7, wherein said preservative is 15–20% by volume.

9. A cleaning concentrate according to claim 1, wherein said cleaning concentrate comprises 30% by volume non-emulsified perfume; 60% by volume nonionic detergent; and 10% by volume preservative.

10. A cleaning concentrate according to claim 1, wherein said perfume is selected from the group of perfumes having one of the gas liquid chromatography profiles presented in FIGS. 1–21.

11. A cleaning concentrate according to claim 10, wherein said detergent comprises a nonylphenol alkyl ether or acid.

12. A cleaning concentrate according to claim 1, wherein said detergent is a nonylphenoxy (polyethyleneoxy)ethanol and said preservative is a dialkylbenzyl dimethyl chloride.

13. A cleaning concentrate according to claim 1, wherein said concentrate is in the form of a liquid.

14. A cleaning concentrate according to claim 1, wherein said concentrate is in the form of a highly viscous liquid.

15. A cleaning composition comprising a concentrate according to claim 1, diluted with water in a volume ratio of 1:10,000 to 1:0.

16. A method for making a cleaning concentrate, comprising:

(a) providing at least one non-ionic detergent in liquid form; and (b) mixing in at least one cationic preservative and a nonemulsified liquid perfume to form a homogeneous solution, mixture or suspension, wherein said concentrate comprises:

(a) 20–40% by volume of said at least one non-emulsified liquid perfume selected from the group consisting of quaternary ammonium halides;

(b) 30–70% by volume of said at least one of said non-ionic detergent; and (c) 5–20% by volume of said at least one cationic preservative, wherein the ratio of detergent to perfume is 0.75–3.5 by volume percent.

17. A method according to claim 16, wherein said detergent is provided in liquid form by heating the detergent.

18. A cleaning concentrate, produced by a method according to claim 16.

* * * * *